US007140555B1

(12) United States Patent
Bricko et al.

(10) Patent No.: US 7,140,555 B1
(45) Date of Patent: Nov. 28, 2006

(54) HYDRAULIC CIRCUIT FOR LINE MARKER HAVING MARKING, FLUSH AND CLEAN OUT MODES OF OPERATION

(75) Inventors: Benjamin A. Bricko, Dundas, MN (US); Timothy S. Martinson, St. Anthony, MN (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 11/132,734

(22) Filed: May 19, 2005

Related U.S. Application Data

(60) Provisional application No. 60/572,447, filed on May 19, 2004.

(51) Int. Cl.

| | |
|---|---|
| ***B05B 15/02*** | (2006.01) |
| ***B05B 9/00*** | (2006.01) |
| ***E01C 23/16*** | (2006.01) |
| *B05B 1/28* | (2006.01) |

(52) U.S. Cl. ..... 239/124; 239/150; 239/113; 239/112; 239/110; 404/93

(58) Field of Classification Search ..... 239/124, 239/150, 113, 112, 110, 104, 106, 126, 127, 239/146, 147, 172, 332, 754; 404/93, 83, 404/94; 118/301, 305; 137/240
See application file for complete search history.

(56) References Cited

U.S. PATENT DOCUMENTS

| | | | | |
|---|---|---|---|---|
| 3,976,231 | A * | 8/1976 | Betulius | 222/616 |
| 4,256,261 | A * | 3/1981 | Gurney | 239/155 |
| 4,267,973 | A * | 5/1981 | Stewart | 239/73 |
| 4,442,975 | A * | 4/1984 | Long et al. | 239/150 |
| 4,624,602 | A | 11/1986 | Kieffer et al. | |
| 5,125,576 | A * | 6/1992 | Ziegenbein | 239/113 |
| 5,302,207 | A | 4/1994 | Jurcisin | |
| 6,053,426 | A * | 4/2000 | Robinson et al. | 239/127 |
| 6,102,304 | A * | 8/2000 | Gonitzke et al. | 239/147 |

OTHER PUBLICATIONS

EZ-100 Striper Brochure, 2003.
Pioneer Model 2000 Brite Striper Brochure, May 2000.
Jiffy 8000 Striper Brochure, undated (admitted prior art base upon current information and belief).

(Continued)

*Primary Examiner*—David A. Scherbel
*Assistant Examiner*—Darren Gorman
(74) *Attorney, Agent, or Firm*—James W. Miller

(57) ABSTRACT

A line marker carries a spray nozzle assembly for marking or painting a line on a horizontal surface. The line marker has a hydraulic circuit which includes a reservoir for holding marking liquid therein and a tank for holding water therein. A pump can pump marking liquid through the spray nozzle during a marking mode of operation or water through the spray nozzle during a flush mode of operation. In the marking mode, at least some marking liquid is recirculated back through the reservoir to help keep the marking liquid in the reservoir agitated and mixed. In the flush mode, water is blocked from entering the reservoir and is recirculated back into the water flow from the tank. In the clean out mode, the hydraulic circuit is operated as if in the marking mode, except that the reservoir is rinsed with an external source of water with the rinse water circulating through the hydraulic circuit and back to the reservoir. At the reservoir, such rinse water is directly conducted by a hose through a drain outlet, thereby speeding the time needed for clean out by avoiding recontamination of the reservoir with rinse water that has already passed through the hydraulic circuit and which is carrying some marking liquid.

19 Claims, 24 Drawing Sheets

OTHER PUBLICATIONS

Newstripe All Pro II Brochure, undated (admitted prior art based upon current information and belief).
Jaydee SP-J5000 Brochure, undated (admitted prior art based upon current information and belief).
Smithco Line Star Brochure, undated (admitted prior art based upon current information and belief).
Topline TXE 505 Advertisement and Brochure, undated (admitted prior art based upon current information and belief).

* cited by examiner

HYDRAULIC CIRCUIT FOR LINE MARKER HAVING MARKING, FLUSH AND CLEAN OUT MODES OF OPERATION

CROSS REFERENCE TO RELATED APPLICATIONS

This application claims the benefit of one or more previously filed copending provisional applications identified as follows: Application Ser. No. 60/572,447 filed May 19, 2004.

TECHNICAL FIELD

This invention relates to apparatus for marking lines or stripes on generally horizontal surfaces, such as sidelines and yardage lines on sports fields, etc.

BACKGROUND OF THE INVENTION

Line markers, also often called line painters or line stripers, mark lines or stripes on horizontal surfaces. Such markers typically mount a spray nozzle adjacent the front end of the marker. Side shields are sometimes provided on either side of the spray nozzle for spray confinement purposes. As the marker travels over the ground, spray exits from the spray nozzle between the side shields and marks a line on the ground or some other horizontal surface such as a mowed grass surface.

One problem with existing line markers is the difficulty in flushing and cleaning the components. Often, many of the components of the hydraulic circuit of the line marker, such as the spray nozzle, valve, liquid supply conduits, etc., must be disassembled for proper cleaning. This is time consuming and messy. Thus, there is a need in the art for a line marker which is easier to flush before short breaks in operation and to clean out before longer breaks in operation.

Further, there is a need in line markers to keep the marking liquid held within a reservoir in an agitated and mixed state during line marking operations. Separate agitators have been known for this purpose. However, such agitators add components, complexity and expense to the line marker. There is a need for a simpler and more cost effective way to keep the marking liquid agitated and mixed as it is held in the reservoir awaiting use.

SUMMARY OF THE INVENTION

One aspect of this invention relates to a hydraulic circuit for a line marker having a spray nozzle for spraying a marking liquid downwardly to mark a line on a horizontal surface. The hydraulic circuit comprises a reservoir for holding a supply of the marking liquid. A pump is provided for pumping the marking liquid from the reservoir and for supplying the marking liquid to the spray nozzle. A selectively operable control valve permits spray of the marking liquid from the spray nozzle when the control valve is in a first state and prevents spray of the marking liquid from the spray nozzle when the control valve is in a second state. A recirculation path is provided for recirculating at least a portion of the marking liquid being pumped by the pump back to the reservoir when the control valve for the spray nozzle is in the second state.

Another aspect for this invention relates to a hydraulic circuit for a line marker having a spray nozzle for spraying a marking liquid downwardly to mark a line on a horizontal surface. The hydraulic circuit comprises a reservoir for holding a supply of the marking liquid. A tank is provided for holding a supply of water. An outlet valve draws marking liquid from the reservoir in a marking mode of operation or water from the tank in a flush mode of operation. A pump is provided for pumping whatever liquid passes through the outlet valve to the spray nozzle.

Yet another aspect for this invention relates to a method of operating a hydraulic circuit of a line marker, the hydraulic circuit comprising a reservoir on the line marker for holding a supply of marking liquid, a tank on the line marker for holding a supply of water, a pump on the line marker for pumping liquid, and a spray nozzle on the line marker for spraying the marking liquid downwardly to mark a line on a horizontal surface. The method comprises pumping the marking liquid from the reservoir through the pump and to the spray nozzle during a marking mode of operation, and pumping water from the tank through the pump and to the spray nozzle during a flush mode of operation.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
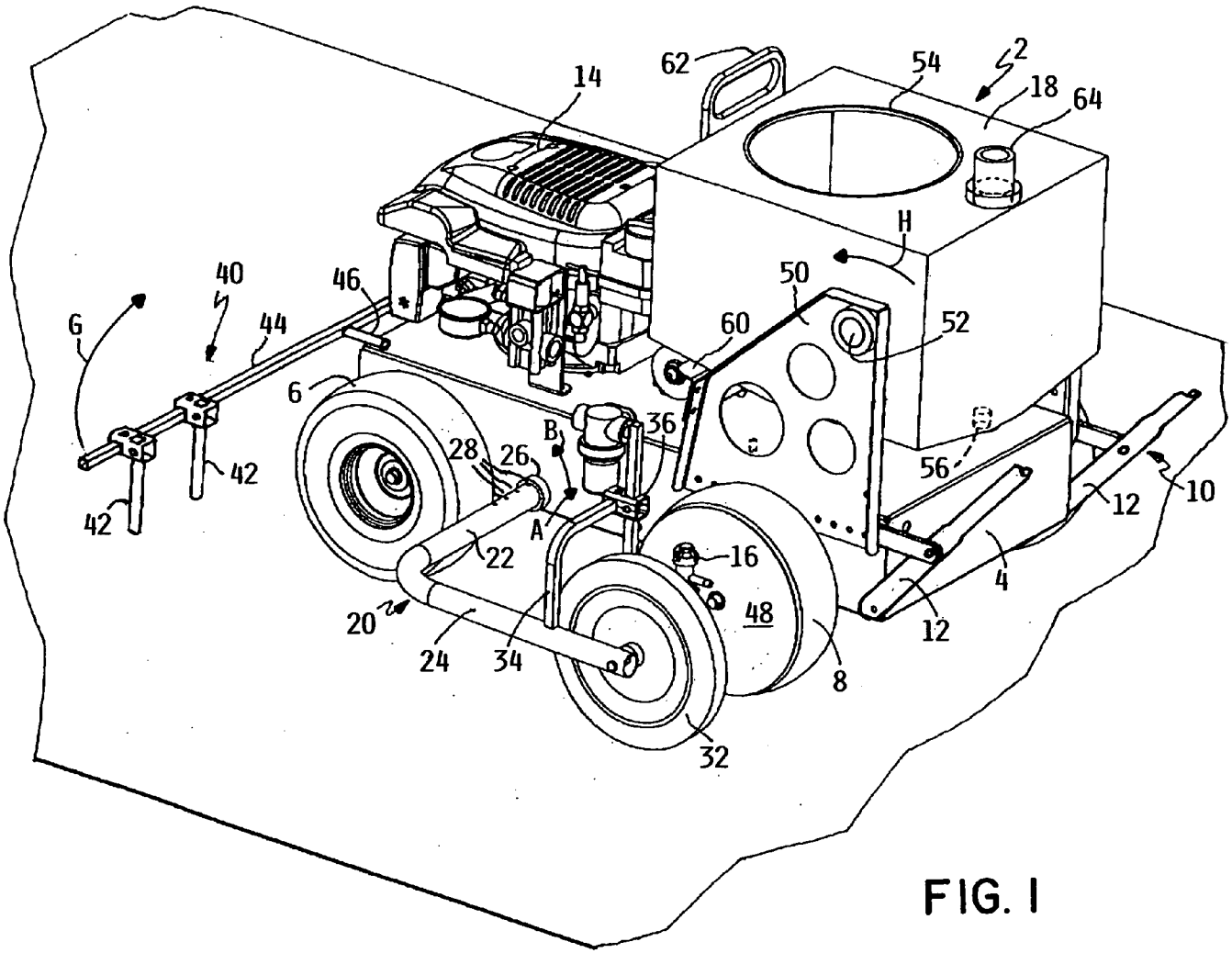
FIG. 1 is a rear perspective view of a walk behind line marker according to a first embodiment of this invention, particularly illustrating the marking liquid reservoir in an upright operational position.
Figure 2:
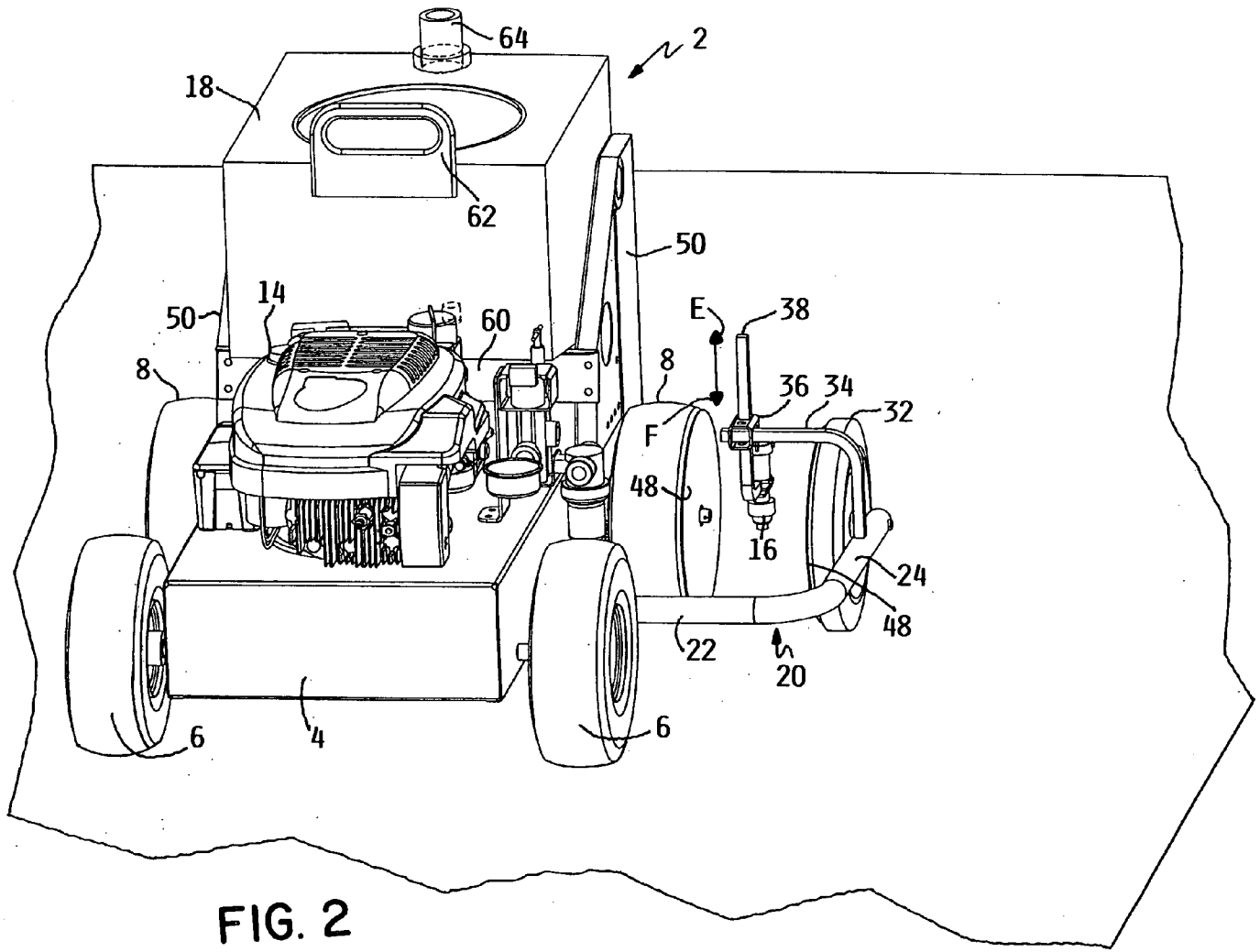
FIG. 2 is a front perspective view of the line marker of FIG. 1.
Figure 3:
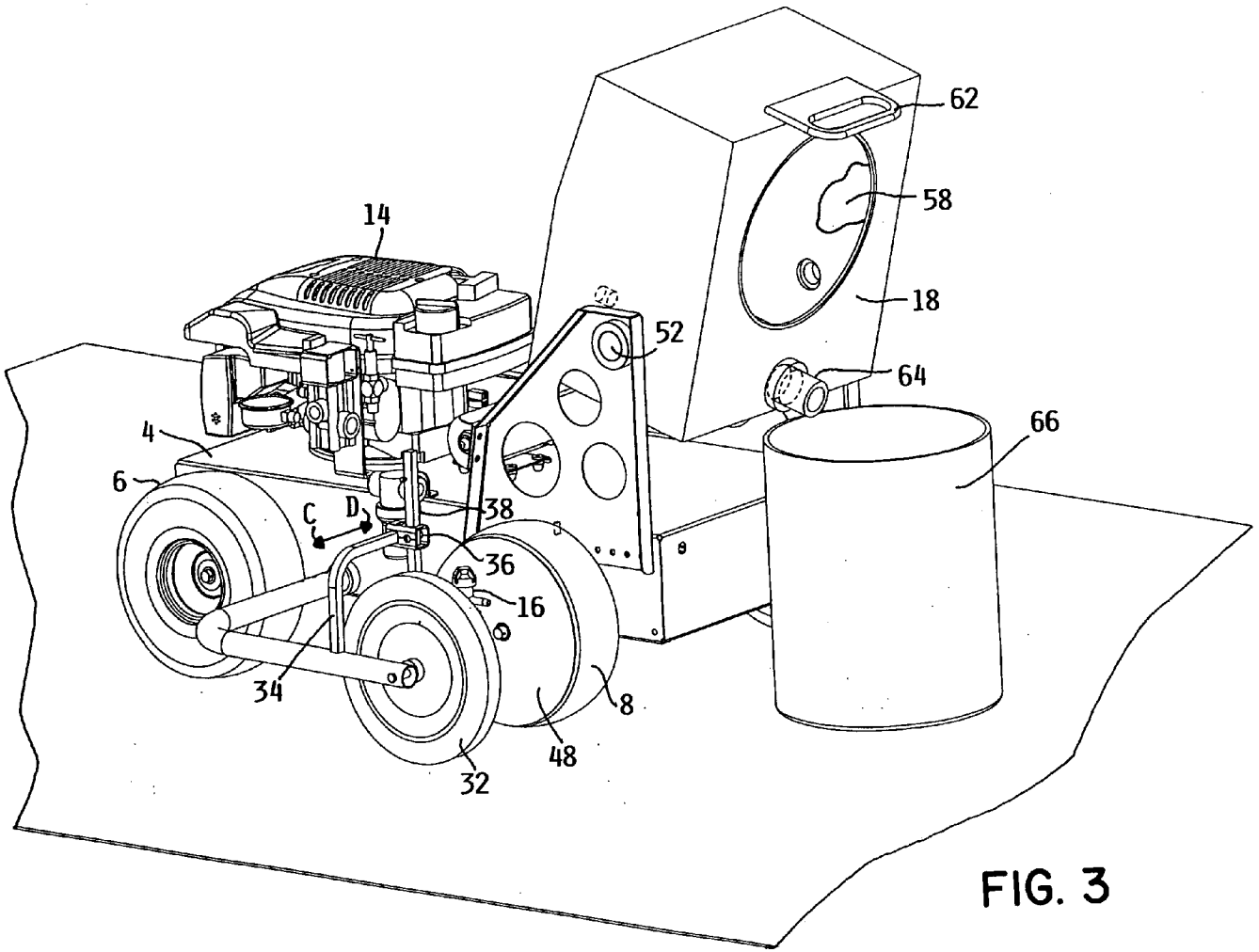
FIG. 3 is a rear perspective view of the line marker of FIG. 1, particularly illustrating the marking liquid reservoir in a tipped, drain position for draining unused marking liquid into a five gallon paint bucket.
Figure 4:
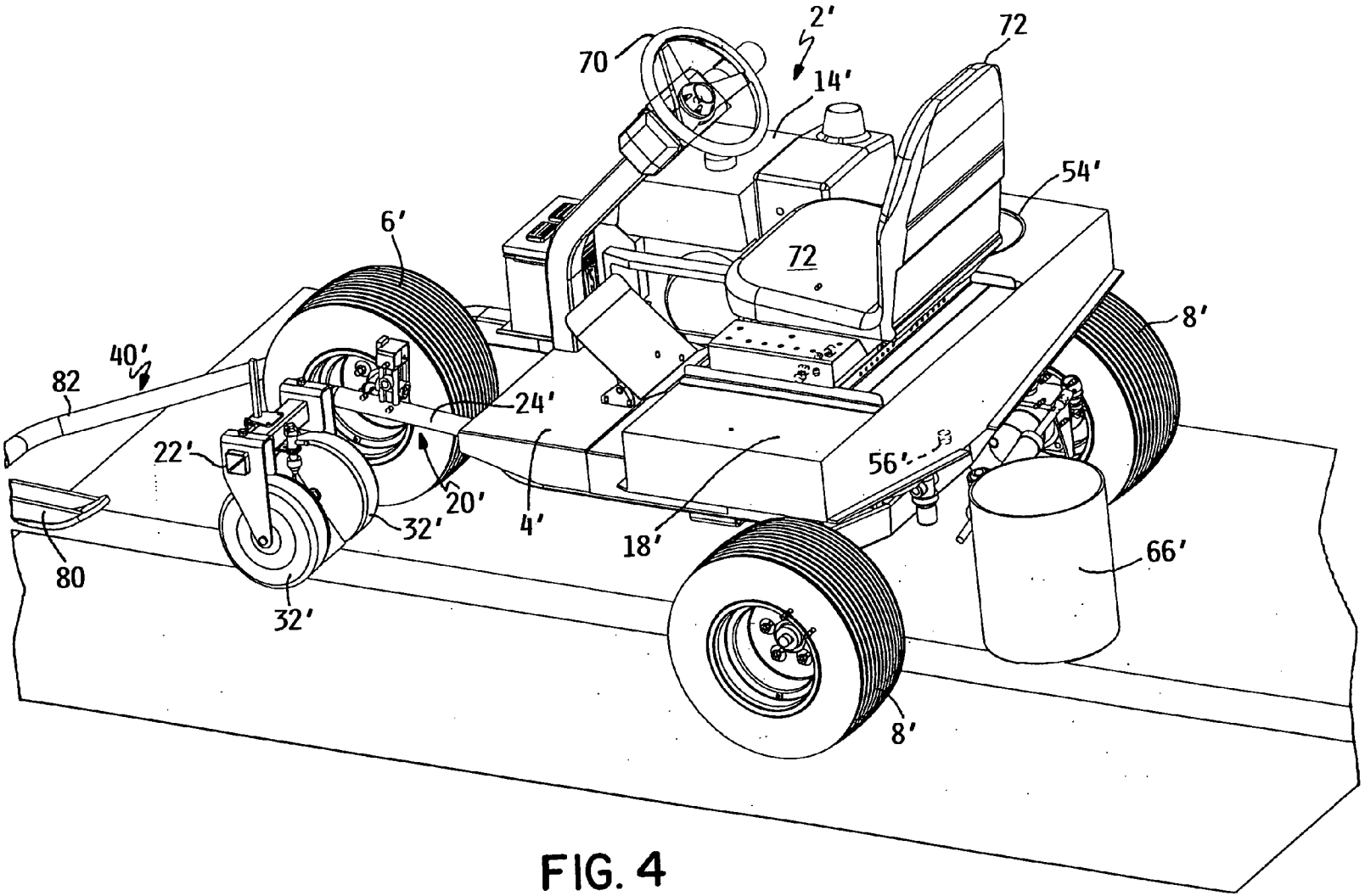
FIG. 4 is a rear perspective view of a riding vehicle line marker according to a second embodiment of this invention, particularly illustrating a five gallon paint bucket positioned beneath the marking liquid reservoir to receive unused marking liquid from the reservoir.
Figure 5:
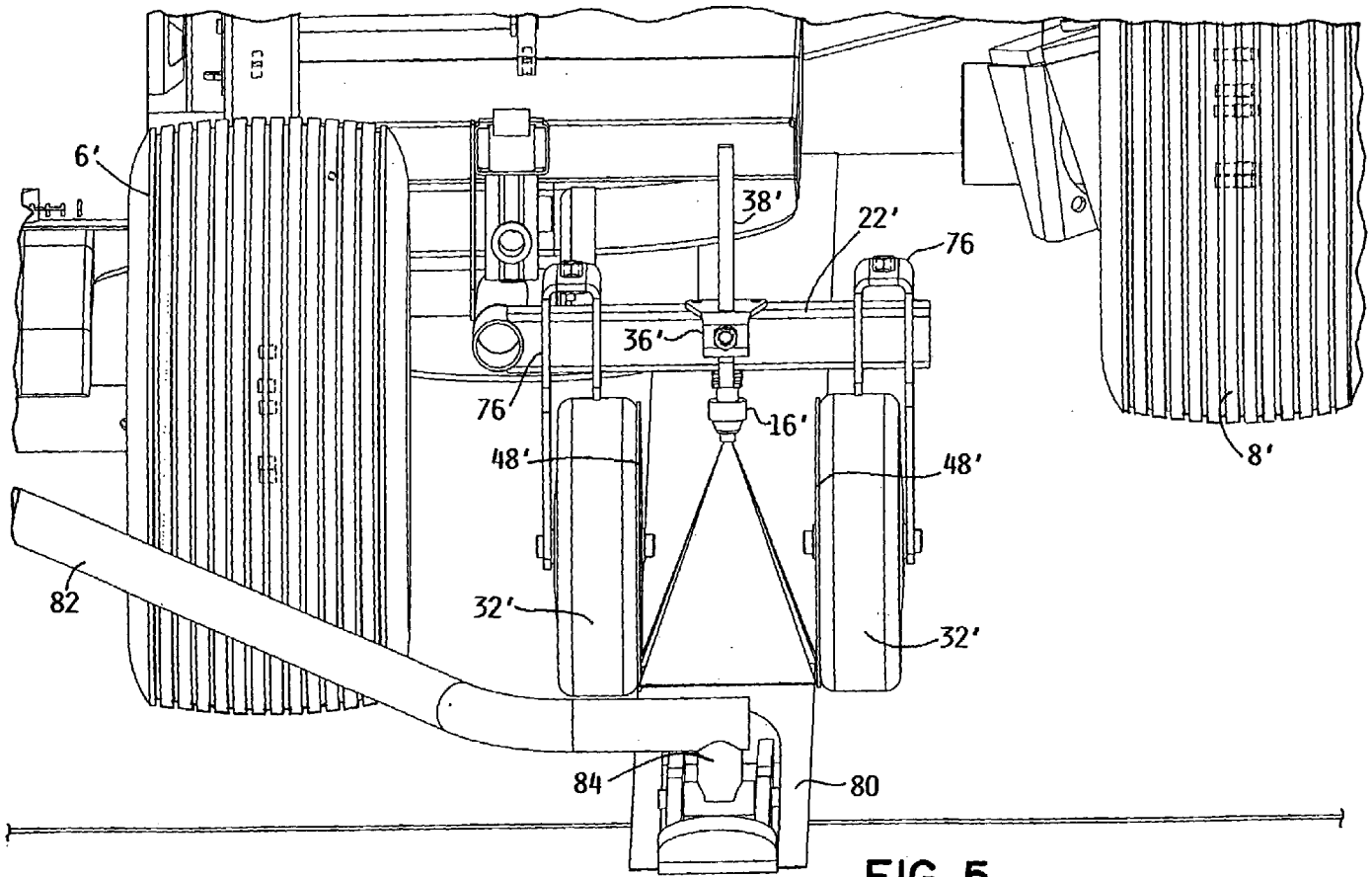
FIG. 5 is a partial front elevational view of the line marker of FIG. 4, particularly illustrating the operation of the spray nozzle and the sight guide while marking a line.
Figure 6:
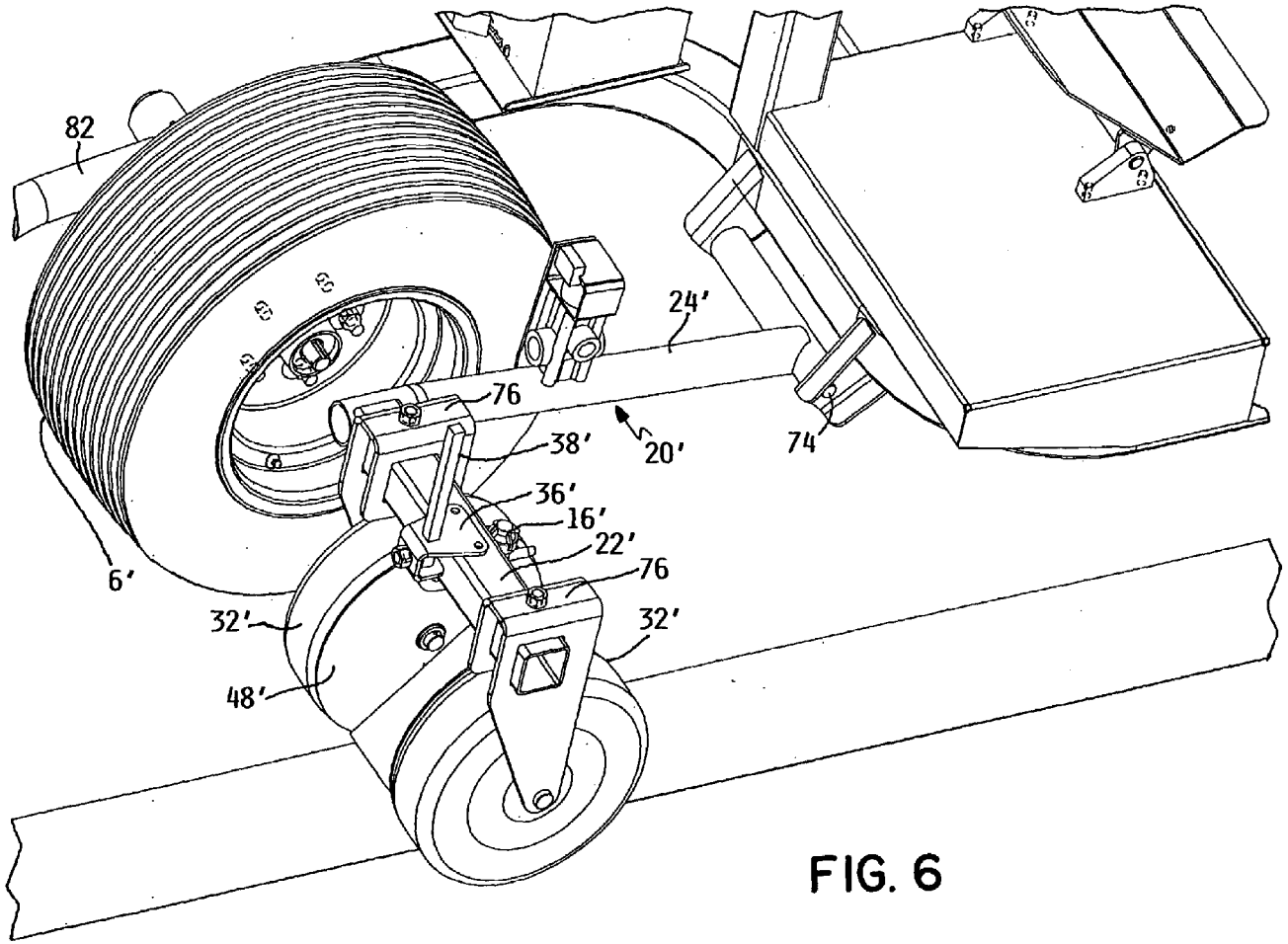
FIG. 6 is a partial front perspective view of the line marker of FIG. 4, particularly illustrating the outrigger arm and the spray nozzle carried on the outrigger arm.
Figure 7:
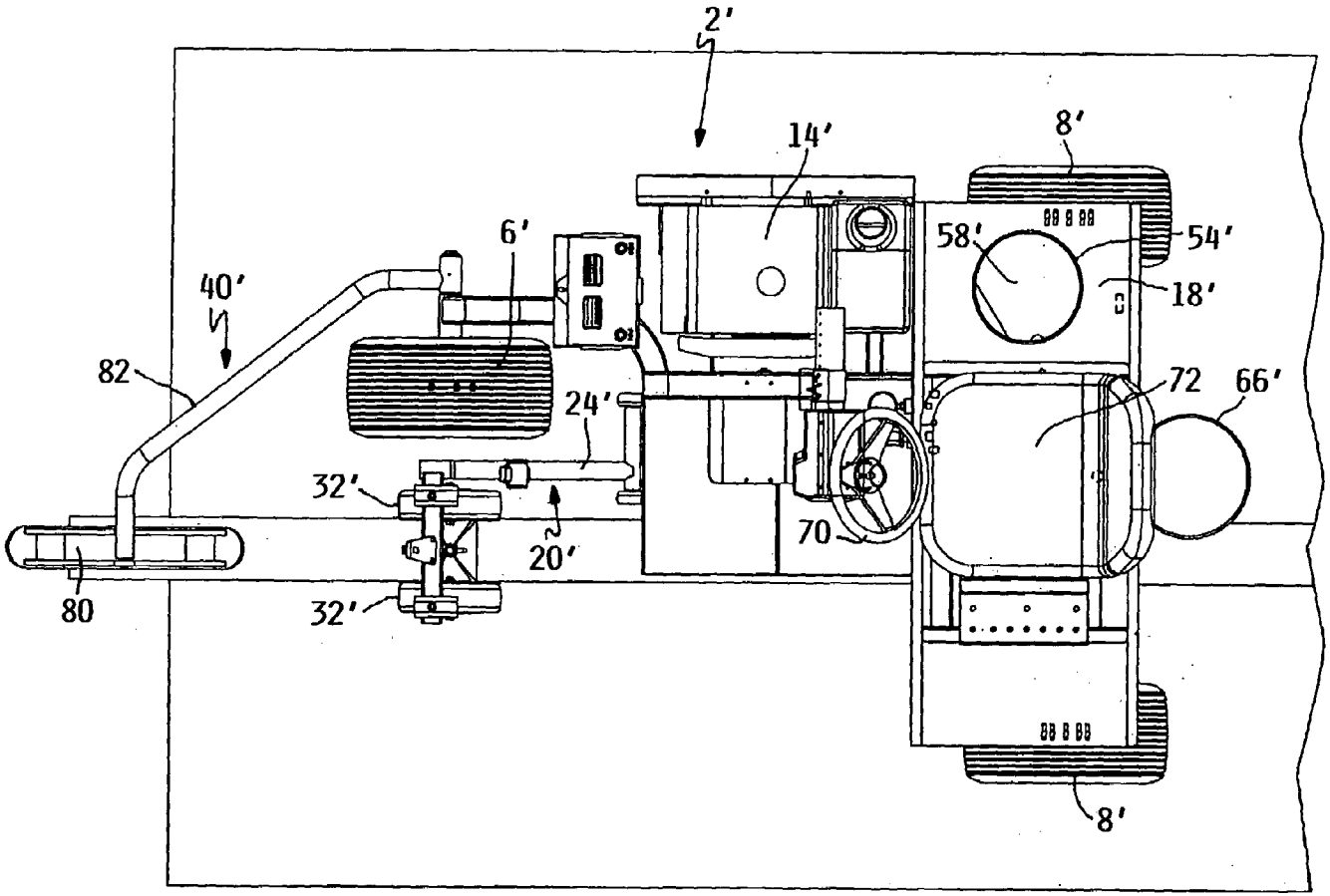
FIG. 7 is a top plan view of the line marker of FIG. 4.

The Embodiment of FIGS. 1–3

A first embodiment of a line marker according to this invention is illustrated generally as 2 in FIGS. 1–3. Line marker 2 includes a generally rectangular chassis or frame 4. A suitable source of power, such as an internal combustion engine 14, is carried on frame 4.

Frame 4 is supported for movement over the ground by a pair of laterally spaced apart front wheels 6 carried on the front end of frame 4 and by a pair of laterally spaced apart rear wheels 8 carried on the rear end of frame 4. Wheels 6 and 8 are rotatable about transverse axles that are fixed to frame 4. In other words, wheels 6 and 8 rotate on the axles to allow frame 4 to roll over the ground, but wheels 6 and 8 do not themselves pivot about a generally vertical axis to permit direct steering of frame 4 through a steering motion of wheels 6 and 8. Some or all of wheels 6 and 8 could comprise non-steerable caster wheels if so desired, e.g. front wheels 6 could comprise caster wheels.

Frame 4 includes a generally U-shaped handle assembly 10 that extends upwardly and rearwardly from the rear end of frame 4. Handle assembly 10 is much like that found on a lawn mower, handle assembly 10 comprising a pair of laterally spaced apart handle tubes 12 connected to opposite sides of frame 4 with handle tubes 12 being joined together at their upper ends by a transverse crosstube (not shown in FIG. 1 but shown as 13 in FIGS. 11 and 12). Only a portion of handle assembly 10 is shown in FIG. 1, namely the attachment of the lower ends of handle tubes 12 to the sides of frame 4. Handle assembly 10 allows an operator to walk behind frame 4 during operation of line marker 2 and to guide and manipulate frame 4 by gripping and manipulating handle assembly 10.

Handle assembly 10 allows the operator to turn or steer frame 4 much like an operator turns or steers a walk behind lawn mower. For example, if the operator wishes to turn or adjust the direction of frame 4 towards the operator's left as the operator stands behind handle assembly 10, the operator pushes on handle assembly 10 to swing the front end of frame 4 towards the left. Even though wheels 6 and 8 themselves are not steerable, the entire frame 4 executes a turn generally about a point lying on or adjacent the transverse axis that contains the axles of rear wheels 8 of frame 4. When turning in such a manner, the front end of frame 4 swings or pivots through a much greater range of motion than the rear end of frame 4.

A line marking system is also carried on frame 4. The line marking system includes a spray nozzle 16 for spraying a marking liquid, a reservoir 18 for holding a supply of marking liquid, and a pump (not shown in FIG. 1) with related connecting conduits or hoses (not shown in FIG. 1) for pumping marking liquid from reservoir 18 to spray nozzle 16. The pump is driven in any suitable manner from engine 14. Handle assembly 10 would also carry one or more controls (not shown in FIG. 1) located conveniently close to the operator's hands for use by the operator for selectively starting and stopping the application of marking liquid through spray nozzle 16.

Spray nozzle 16 is carried on frame 4 through a pivotal, ground following outrigger arm 20. Outrigger arm 20 is L-shaped having a transverse leg 22 and a longitudinal leg 24. Transverse leg 22 of outrigger arm 20 is pivotally connected to one side of frame 4 by a fixed pivot hub 26 located on one side of frame 4 between front and rear wheels 6 and 8. In addition, transverse leg 22 of outrigger arm 20 is provided with a plurality of sets of laterally spaced holes 28 to be able to selectively adjust the distance between the side of frame 4 and longitudinal leg 24 of outrigger arm 20.

A locking pin (not shown) can be dropped down through one set of holes 28 in transverse leg 22 of outrigger arm 20 to prevent leg 22 from being pushed axially inwardly through pivot hub 26. Transverse leg 22 is long enough to pass all the way through frame 4 and through a matching pivot hub (not shown) on the other side of frame 4. Then, another locking pin (not shown) can be inserted into a matching set of holes (not shown) on the other end of leg 22 to finish securing leg 22 to frame 4, i.e. to prevent leg 22 from being pulled axially back out of the hub 26 illustrated in FIG. 1. Other ways of pivotally coupling outrigger arm 20 to frame 4 could be used.

The rear end of longitudinal leg 24 of outrigger arm 20 carries a rotatable ground engaging wheel 32. Thus, as frame 4 moves forwardly over the ground, outrigger arm 20 is free to pivot or pitch in either direction about the horizontal axis of pivot hub 26, as represented by the arrows A and B in FIG. 1, to allow the rear end of outrigger arm 20 to move up and down and to follow the contours of the ground. This ground following action of outrigger arm 20 takes place even for very localized changes in ground contour that might not affect frame 4 to the same degree. Longitudinal leg 24 of outrigger arm 20 is long enough so that the axis of rotation of outrigger wheel 32 is located substantially along the axis of rotation of rear wheels 8 of frame 4, though obviously outrigger wheel 32 is laterally spaced outside of rear wheel 8 carried on that side of frame 4 that mounts outrigger arm 20.

As shown particularly in FIGS. 1 and 2, spray nozzle 16 is adjustably carried on outrigger arm 20 to be located between rear wheel 8 on frame 4 and outrigger wheel 32 on outrigger arm 20. In this respect, an L-shaped cantilever support arm 34 is secured to longitudinal leg 24 of outrigger arm 20 with support arm 34 extending towards the side of frame 4 in front of the gap located between rear wheel 8 and outrigger wheel 32. A mounting bracket 36 is slidable on support arm 34 and can be clamped in a laterally adjusted position on support arm 34 by a set or thumb screw (not shown) or the like. Thus, mounting bracket 36 can be slid back and forth on support arm 34 in the direction of arrows C and D in FIG. 3.

A downwardly facing spray nozzle 16 is secured to mounting bracket 36 by an L-shaped mounting arm 38. The vertical leg of mounting arm 38 passes through mounting bracket 36 to allow spray nozzle 16 to be vertically adjustable towards or away from the surface that is being striped or marked, such surface being depicted by the representation of a plane in FIGS. 1–3 on which line marker 2 is supported. Again, the vertical leg of mounting arm 38 can be clamped in place on mounting bracket 36 by a set or thumb screw (not shown). The vertical adjustability of spray nozzle 16 is represented by the arrows E and F in FIG. 2.

The horizontal leg of mounting arm 38 is long enough so that spray nozzle 16 is located on or substantially on the axis of rotation of rear wheels 8 of frame 4.

A sight guide 40 can be provided on frame 4 comprising one or more downwardly facing guide fingers 42. As shown in FIG. 1, a pair of such guide fingers 42 are carried on an arm 44 extending laterally from one side of frame 4. Guide fingers 42 are slidable along arm 44 relative to each other and can be clamped or locked in place in any suitable manner on arm 44. Guide fingers 42 are long enough to extend down close to the surface to be marked but terminate slightly above such surface.

Arm 44 can either be fixed to frame 4 or can be pivotally carried on frame 4 for pivoting motion about a longitudinal pivot axis (not shown) on frame 4. When arm 44 is pivotally attached to frame 4, sight guide 40 can be pivoted upwardly out of the way when desired. The pivoting of sight guide 40 can be done through a lift cable or the like (not shown) extending back to handle assembly 10. When the operator pulls on the lift cable, arm 44 carrying guide fingers 42 will pivot upwardly on the front end of frame 4 to lift guide fingers 42 up and out of the way as depicted by the arrow G in FIG. 1. A stop 46 on arm 44 engages against frame 4 when sight guide 40 is down to define the normal operational position of sight guide 40 as depicted in FIG. 1.

In using line marker 2 shown in FIGS. 1–3, the operator can set a desired width for the line to be marked by adjusting the spacing between rear wheel 8 and outrigger wheel 32. This is done by adjusting how far outrigger wheel 32 is spaced away from frame 4 using one selected set of locking holes 28. When the distance between wheels 8 and 32 has been set, then spray nozzle 16 is horizontally adjusted by sliding mounting bracket 36 on support arm 34 to center spray nozzle 16 in the gap between wheels 8 and 32. If need be, spray nozzle 16 is also vertically adjusted so that the liquid spray exiting nozzle 16 will mark or stripe a line whose width is approximately equal to the distance between wheels 8 and 32, though spray nozzle 16 could also be vertically adjusted to mark or stripe a line whose width is smaller than the distance between wheels 8 and 32. The facing surfaces of wheels 8 and 32, namely the outer side of wheel 8 and the inner side of wheel 32, are equipped with flat spray shields 48 for spray confinement and wheel protection purposes. Thus, the marking or striping action takes place in the gap between wheels 8 and 32 and such wheels serve to shield or confine the liquid spray.

Once spray nozzle 16 is adjusted to provide a desired width of line, guide fingers 42 on sight guide 40 can also be adjusted similarly. In this regard, each guide finger would be adjusted on support arm 34 to be aligned with one edge of the line that is to be marked. For example, the outer guide finger 42 on arm 44 would be slid on arm 44 until the outer guide finger 42 is aligned with the outer edge of the line and then the outer guide finger 42 would be locked in place. The same thing would be done for the inner guide finger 42 except that the inner guide finger would be aligned with the inner edge of the line. Instead of using two guide fingers 42, only one such guide finger 42 could be used aligned with either the outer or inner edge of the line that is to be marked.

After spray nozzle 16 and sight guide 40 are adjusted, the operator can then stand behind frame 4 and grip handle assembly 10 to push and guide frame 4 forwardly in a direction to mark a straight line on a substantially horizontal surface, such as on a paved surface, a turf surface or the like. Frame 4 could be self-propelled from engine 4 using any suitable lawn mower type self propel system. As the operator walks behind the forwardly traveling frame 4, the operator can use whatever hand control is provided on handle assembly 10 to initiate spraying of the marking liquid held in reservoir 18 through spray nozzle 16.

The operator can use guide fingers 42 on sight guide 40 to help follow and mark a substantially straight line. For example, guide fingers 42 might be used to follow either side of a previously marked but now faded line to enable a new, fresh line to be marked over the faded line. Or, guide fingers 42 might be used to follow a string that marks at least one edge of the desired line.

In marking a line, line marker 2 is effective in marking a substantially straight line having a relatively constant width. Spray nozzle 16 is aligned with the axis of rotation of the non-steerable rear wheels 8 on frame 4 which is the axis about which frame 4 pivots when turning. Thus, very little side-to-side motion of spray nozzle 16 will occur even if the operator has to use handle assembly 10 to make some adjustments in the path of travel of frame 4 as the operator attempts to guide frame 4 in a straight path. For example, if frame 4 begins to deviate from its intended course, the operator will have to push on handle assembly 10 to turn frame 4 somewhat to realign guide fingers 42 and thus spray nozzle 16 with the intended direction of travel. However, the rear end of frame 4 along the axis of rear wheels 8 moves very little in such correctional movements and thus the line being marked does not itself appreciably veer or move to the side, which would happen to a much larger degree if spray nozzle 16 were carried on the front of frame 4. Thus, placement of spray nozzle 16 as shown on the embodiment of the walk behind line marker of FIGS. 1–3 provides a straighter, less wavy line.

In addition, spray nozzle 16 is carried on a separate pivotal outrigger arm 20 such that spray nozzle 16 will move up and down with the contours of the surface over which spray nozzle 16 is passing. This keeps the tip of spray nozzle 16 at a relatively constant distance above the surface. In turn, this ensures that a line of relatively constant width is being sprayed by spray nozzle 16. Thus, line marker 2 of FIGS. 1–3 gives a line of more uniform width than many line markers known in the prior art.

Reservoir 18 of line marker 2 of FIGS. 1–3 is pivotally mounted between side brackets 50 on frame 4 for pivotal motion about a substantially horizontal pivot axis 52. As shown in FIG. 1, reservoir 18 has an upper fill inlet 54, which is shown open in FIG. 1, through which a marking liquid can be poured into reservoir 18. The marking liquid will be drawn through an outlet 56 at the lowermost point of reservoir 18 when the pump is operated to pump the marking liquid through a suitable conduit or hose to spray nozzle 16. Fill inlet 54 of reservoir 18 is normally closed by a lid or cover 58, which lid or cover 58 is not shown in FIG. 1 but is shown in FIG. 3.

Referring further to FIG. 1, reservoir 18 is normally maintained in an upright position in which reservoir 18 is rotated about pivot axis 52 to a forward, generally upright position with the bottom of reservoir 18 resting on a support rail 60 extending between side brackets 50. The weight of the marking liquid within reservoir 18 as well as the weight of reservoir 18 itself will normally keep reservoir 18 in this normal, upright operational position due to the placement of pivot axis 52 at the rear and upper portion of reservoir 18. The weight of the marking liquid and the weight of reservoir 18 exerts a torque in the direction of the arrow H tending to maintain reservoir 18 in the orientation shown in FIG. 1.

However, when it is time to empty reservoir 18 of unused marking liquid after a line marking operation is completed, the operator can grab a handle 62 at the front upper edge of reservoir 18 and tip or rotate reservoir 18 rearwardly about its pivot axis 52. A drain outlet 64 on the top of reservoir 18 adjacent fill inlet 54 will be rotated with reservoir 18 until drain outlet 64 inclines somewhat downwardly relative to the horizontal in a tipped, drain orientation of reservoir 18 as shown in FIG. 3. In this tipped, drain orientation of reservoir 18, drain outlet 64 is now at or adjacent the lowermost portion of reservoir 18. Thus, any unused marking liquid remaining in reservoir 18 can drain from reservoir 18 through drain outlet 64 and can be caught in a suitable receptacle.

While many receptacles could be used to catch the unused marking liquid draining from reservoir 18, it is preferred that the receptacle comprise a standard five gallon paint bucket having the usual 15" height. Thus, the size and shape of reservoir 18, the location of pivot axis 52 for reservoir 18, and the location of drain outlet 64 on reservoir 18 are chosen such that drain outlet 64 when inclined downwardly relative to the horizontal will be above the rim of a five gallon paint bucket 66 that is simply sitting on a horizontal surface such as the ground. Thus, in the tipped, drain orientation of reservoir 18 as shown in FIG. 3, the lower edge of drain outlet 64 will be at least approximately 15" high or higher to enable drain outlet 64 to empty into a five gallon paint bucket 66. This eases cleanup of line marker 2 by permitting easy disposal of marking liquid from reservoir 18 into a standard five gallon paint bucket that is usually readily available and at hand. In addition, the unused marking liquid can then be stored in paint bucket 66 and simply poured back into reservoir 18 through fill inlet 54 the next time line marker 2 is to be used.

The Embodiment of FIGS. 4–7

A second embodiment of a line marker according to this invention is illustrated generally as 2' in FIGS. 4–7. Line marker 2' of the second embodiment incorporates numerous component parts which are substantially identical or similar to those employed in line marker 2 of the first embodiment herein. Such component parts have been identified with the same reference numerals utilized herein before, but have been differentiated therefrom by means of prime (') notations, e.g. line marker 2' instead of line marker 2.

Line marker 2' comprises a riding vehicle having a frame 4' supported by a pair of rear drive wheels 8' and a single front wheel 6' arranged in a tricycle configuration. Rear drive wheels 8' are steerable to change the direction of frame 4' while front wheel 6' is rotatable about a fixed transverse axle. The operator can steer rear drive wheels 8' using a steering wheel 70 located adjacent a seat 72 on frame 4' for carrying the operator. Standard operational controls are also carried on frame 4' adjacent seat 72 to allow the operator to control the traction drive to rear drive wheels 8'. Frame 4' carries a power source, such as an internal combustion engine 14'.

In line marker 2', reservoir 18' is fixed in place on the rear end of frame 4' beneath the operator's seat 72. Again, reservoir 18' has an upper, fill inlet 54' normally closed by a lid or cover 58'. Reservoir 18' also has an outlet 56' at its lowermost portion for allowing the marking fluid inside of reservoir 18' to be pumped from reservoir 18' by the pump of the line marking system and supplied to spray nozzle 16'.

In addition, reservoir 18' has a drain outlet (not shown) positioned in the rear or bottom sides of reservoir 18'. Reservoir 18' is positioned high enough on frame 4' and frame 4' is itself high enough above the ground that a five gallon paint bucket 66' can be slid beneath the rear end of reservoir 18'. When so positioned, the five gallon paint bucket 66' will also be located beneath the drain outlet of reservoir 18'. Thus, to drain unused marking fluid from reservoir 18' into bucket 66', the operator need only remove a plug or cap or open a valve on the drain outlet and the unused marking fluid will simply flow by gravity down into bucket 66'. This occurs even without having to tip reservoir 18' as in line marker 2 since line marker 2' achieves the same result with a fixed reservoir 18' that is located high enough on frame 4' to allow a bucket 66' to be placed beneath the drain outlet on reservoir 18'.

In line marker 2', spray nozzle 16' is carried on a pivotal outrigger arm 20' that pivots about a substantially horizontal pivot axis 74 on the front end of frame 4'. Outrigger arm 20' has a longitudinal leg 24' and a transverse leg 22'. A pair of ground engaging wheels 32' are carried on transverse leg 22' of outrigger arm 20' by a pair of wheel support brackets 76. Wheel support brackets 76 are slidably mounted on transverse leg 22' of outrigger arm 20' to allow the distance between them to be adjusted. Each of the facing sides of outrigger wheels 32' are provided with planar spray shields 48'. Thus, spray nozzle 16' will spray between the two wheels 32' with the planar shields 48' on wheels 32' serving as spray confinement and wheel protection devices.

As in line marker 2, spray nozzle 16' for line marker 2' is also vertically adjustable between outrigger wheels 32' of outrigger arm 20'. Spray nozzle 16' faces downwardly and is carried on the vertical leg of a mounting arm 38'. The vertical leg of mounting arm 38' passes through a mounting bracket 36' that is fixed to the center of transverse leg 22' of outrigger arm 20'. The vertical leg of mounting arm 38' may be locked in a vertically adjusted position by a set screw or set bolt passing through bracket 36' and bearing against the vertical leg of mounting arm 38'. The same type of set screw or set bolt may be used to lock each wheel support bracket 76 in laterally adjusted positions on transverse leg 22' of outrigger arm 20'.

In adjusting spray nozzle 16' of line marker 2', the width of the line being sprayed is established by laterally moving each outrigger wheel 32' on outrigger arm 20' towards or away from spray nozzle 16' until the distance between the two wheels 32' is generally or substantially the same as the width of the line that is to be sprayed. In this regard, spray nozzle 16' remains fixed in place on transverse leg 22' of outrigger arm 20' and the pair of wheels 32' are both adjusted relative to spray nozzle 16' until each wheel 32' is located about the same distance from spray nozzle 16' but on opposite sides of spray nozzle 16'. The vertical position of spray nozzle 16' is then adjusted so that the width of the spray as it hits the surface being marked is also approximately equal to the width of the desired line.

Spray nozzle 16' in line marker 2' is also positioned along the axis of rotation of the non-steerable front wheel 6' of line marker 2'. This means that the operator can correct the direction of line marker 2' to attempt to mark a straight line by steering rear wheels 8' without appreciably affecting the path of motion of spray nozzle 16' and without causing spray nozzle 16' to substantially depart from a straight path. This enhances the ability of line marker 2' to spray a straight, non-wavy line. In addition, because spray nozzle 16' is carried on a pivotal outrigger arm 20', spray nozzle 16' follows the contours of the surface that is being marked to provide a fairly constant line thickness or width.

Sight guide 40' of line marker 2' is somewhat different than sight guide 40 in line marker 2. Sight guide 40' includes a ski-shaped skid 80 carried on the front end of a pivotal arm 82. Arm 82 pivots at its rear end about the same substantially horizontal axle that carries the non-steerable front wheel 6. See FIG. 7. Arm 82 has an offset angled portion sufficient to allow the front end of arm 82 to be positioned in front of outrigger arm 20' and spray nozzle 16'. In addition, skid 80 can also be pivotally mounted on the front end of pivotal arm 82 through any suitable pivot connection 84.

In line marker 2', sight guide 40' also follows the contours of the ground by virtue of the pivotal connection of pivotal arm 82 to frame 4'. In addition, skid 80 comprising sight guide 40' can pivot on the front end of arm 82 through pivot connection 84. The operator can use sight guide 40' to help the operator guide the direction of frame 4' when attempting to mark a straight line.

In addition, in line marker 2', the operator's seat 72 is positioned on frame 4' generally behind or in line with skid 80 and spray nozzle 16', with engine 14' being offset to one side of frame 4'. See FIG. 7. This allows the operator to clearly see skid 80 and to line up skid 80 with its intended path of travel. This also allows the operator to see and monitor the performance of spray nozzle 16' during line marking. This in line placement of the operator's seat and the unobstructed view of the operator further enhances the ability of the operator to spray a straight, non-wavy line.

The Embodiment of FIGS. 8–24

A third embodiment of a line marker according to this invention is illustrated generally as 2" in FIGS. 8–24. Line marker 2" of the third embodiment incorporates numerous component parts which are substantially identical or similar to those employed in line markers 2 or 2' of the first two embodiments herein. Such component parts have been identified with the same reference numerals utilized herein before, but have been differentiated therefrom by means of double prime (") notations, e.g. line marker 2" instead of line marker 2 or line marker 2'.

Line marker 2" shown in FIGS. 8–24 is a walk behind line marker like that shown in FIGS. 1–3. However, instead of having a pair of front wheels 6, line marker 2" has a single, pivotal, non-steerable front caster wheel 6". The rear wheels 8" are rotatable on a fixed axle or axles carried on frame 4" with rear wheels 8" also not being themselves directly steerable. The operator steers line marker 2" only by pushing on one side or the other of handle assembly 10" to steer line marker 2" like a walk behind lawn mower, e.g. by steering frame 4" about a point on or relatively closely adjacent the rotational axis of rear wheels 8".

Outrigger arm 20" of line marker 21" again has a longitudinal leg 24" pivotally connected to frame 4" and a transverse leg 22" which extends laterally of frame 4". Transverse leg 22" carries spray nozzle 16".

Longitudinal leg 24" of outrigger arm 20" has an inwardly extending stub shaft portion 23 pivotally carried in a pivot hub 26" on one side of frame 4". Stub shaft portion 23 of longitudinal leg 24" includes elongated slots 86 on the top and bottom thereof with only one such slot 86 shown in FIG. 13. Pivot hub 26" includes holes 88 in the top and bottom thereof for receiving a lock pin 89 that passes down through holes 88 and through slots 86. Lock pin 89 retains outrigger arm 20" within pivot hub 26", but slots 86 allow outrigger arm 20" to be pivotally adjusted on frame 4".

A threaded height adjustment rod 90 is carried in a threaded bore 92 on the side of longitudinal leg 24" closest to frame 4". Rod 90 is double headed having an enlarged head 94 on each end. The purpose for making rod 90 double headed will be described later.

A wing nut 96 and other jam nuts (not shown) lock rod 90 in a height adjusted position within bore 92. When wing nut 96 and the jam nuts are loosened, rod 90 can be rotated in one direction within bore 92 to draw rod 90 up within bore 92. Alternatively, rod 90 can be rotated in the opposite direction within bore 92 to extend rod 90 down out of bore 92. When rod 90 is in a desired position, wing nut 96 and the jam nuts can be tightened to hold rod 90 in such position.

Rod 90 is adjustable within bore 92 to vary or extend the distance between lower head 94 on rod 90 and the underside of outrigger arm 20". Lower head 94 on rod 90 rests on top of a fixed rear stop 98 on frame 4". Since the vertical position of lower head 94 of rod 90 is fixed by rear stop 98, varying the distance between lower head 94 on rod 90 and the underside of outrigger arm 20" forces outrigger arm 20" to pivot within pivot hub 26" either upwardly or downwardly. Such a pivotal adjustment of outrigger arm 20" adjusts transverse leg 22" of outrigger arm 20", i.e. the portion of outrigger arm 20" that carries spray nozzle 16", to a different vertical height above the ground.

Figure 16:
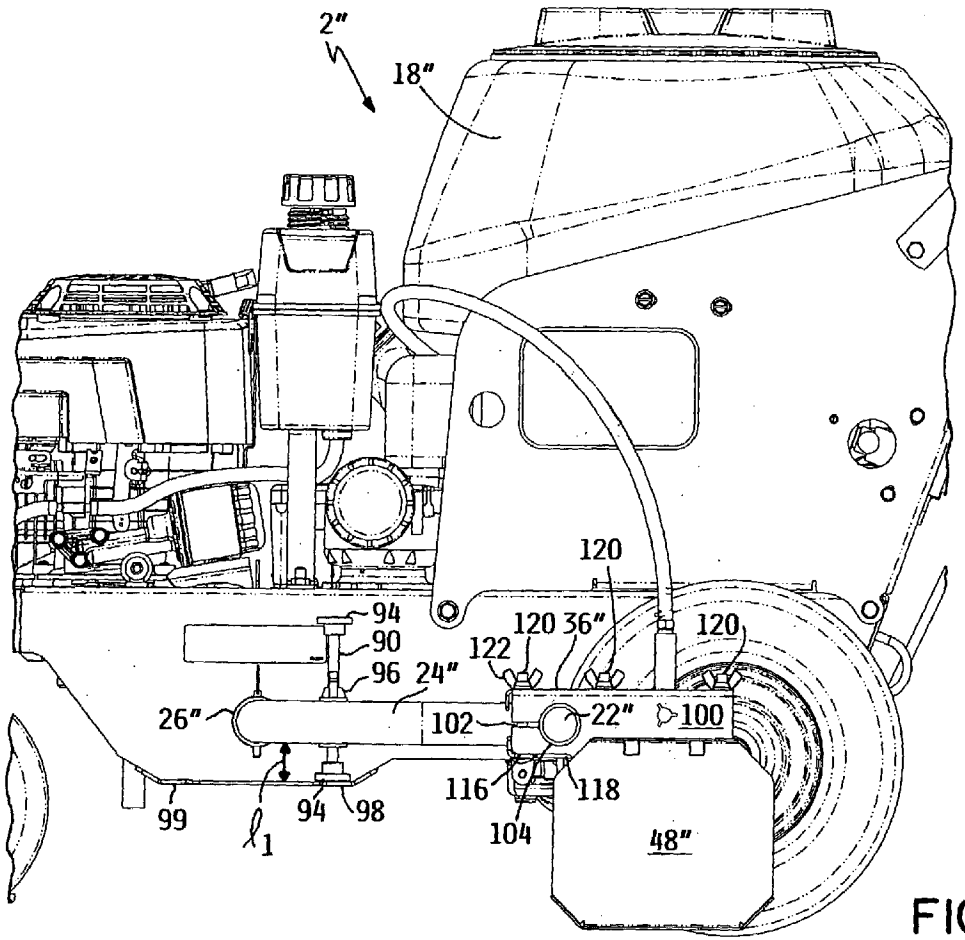
FIG. 16 is a partial side elevational view of the line marker of FIG. 8, particularly illustrating the outrigger arm in a first pivotally adjusted position for carrying the spray nozzle at a first height above the ground.
Figure 17:
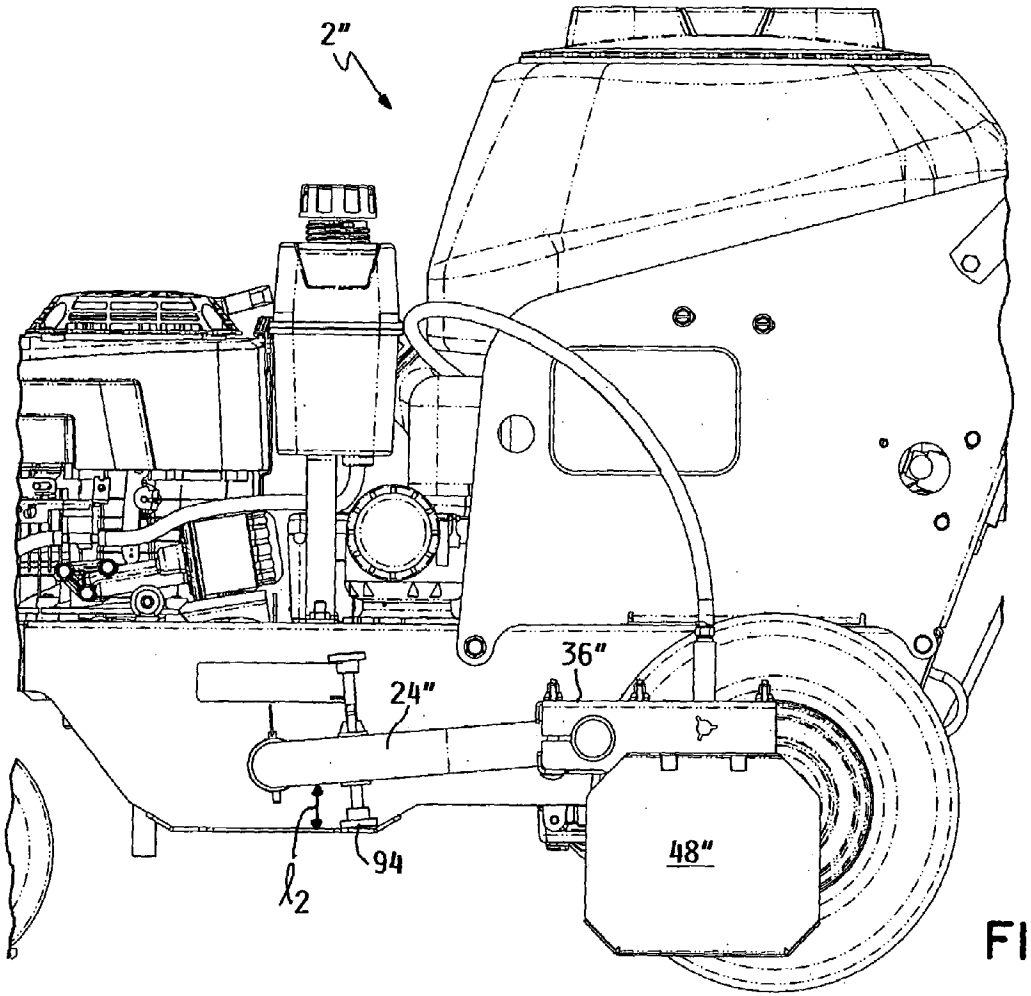
FIG. 17 is a partial side elevational view of the line marker similar to FIG. 16, particularly illustrating the outrigger arm in a second pivotally adjusted position for carrying the spray nozzle at a second height above the ground that is higher than the first height shown in FIG. 16.

The pivotal adjustment of outrigger arm 20" on frame 4" is illustrated in FIGS. 16 and 17. As shown in FIG. 16, when the distance between lower head 94 of rod 90 and the underside of longitudinal leg 24" is set at a first value $l_1$, longitudinal leg 24" of outrigger arm 20" is substantially horizontal relative to the ground to position spray nozzle 16" at a first vertical distance above the ground. If the distance between lower head 94 of rod 90 and the underside of leg 24" is lengthened to become longer as shown by the distance $l_2$ in FIG. 17, then longitudinal leg 24" of outrigger arm 20" is forced by rear stop 98 to incline upwardly relative to the horizontal to raise spray nozzle 16" higher above the ground. The mounting bracket 36" for spray nozzle 16" can be rotated on transverse leg 22" of outrigger arm 20" after such a height adjustment to maintain mounting bracket 36" and the tip of spray nozzle 16" substantially parallel to the ground.

Obviously, outrigger arm 20" in line marker 2" is no longer a ground following arm, but is maintained above the ground at a particular fixed position to maintain a desired operational height of spray nozzle 16" relative to frame 4". The height adjustability permits a line having a given width to be sprayed onto a plane arranged at different vertical heights to a reference plance, such as the ground. For example, if a line is being sprayed onto a surface at ground level, then outrigger arm 20" will be adjusted so that the line will be sprayed to its full width just where the spray contacts the ground. But, if the line is desirably being sprayed onto a grass surface which has been mowed to a predetermined height (e.g. 2" above ground level), then outrigger arm 20" will be raised using rod 90 to raise spray nozzle 16" by the same amount so that the line will be sprayed to its full width at a vertical elevation substantially equal to the height of the grass (i.e. 2" in the foregoing example). This adjustability also helps keep the lower ends of side shields 48" from dragging through the grass and marring the sides of the marked line, i.e. the sides of the marked line will be sharper and more distinct.

Mounting bracket 36" that carries or mounts spray nozzle 16" comprises a downwardly facing U-shaped channel member. Mounting bracket 36" has a pair of spaced side walls 100 that are each split at one end at 102. Split ends 102 lead to a circular aperture 104 in each side wall 100. Mounting bracket 36" slides onto the outer end of transverse leg 22" of outrigger arm 20" by passing transverse leg 22" through apertures 104 in side walls 100 of mounting bracket 36". When split ends 102 of mounting bracket 36" are vertically compressed, mounting bracket 36" is clamped or fixed securely to transverse leg 22" of outrigger arm 20".

Figure 13:
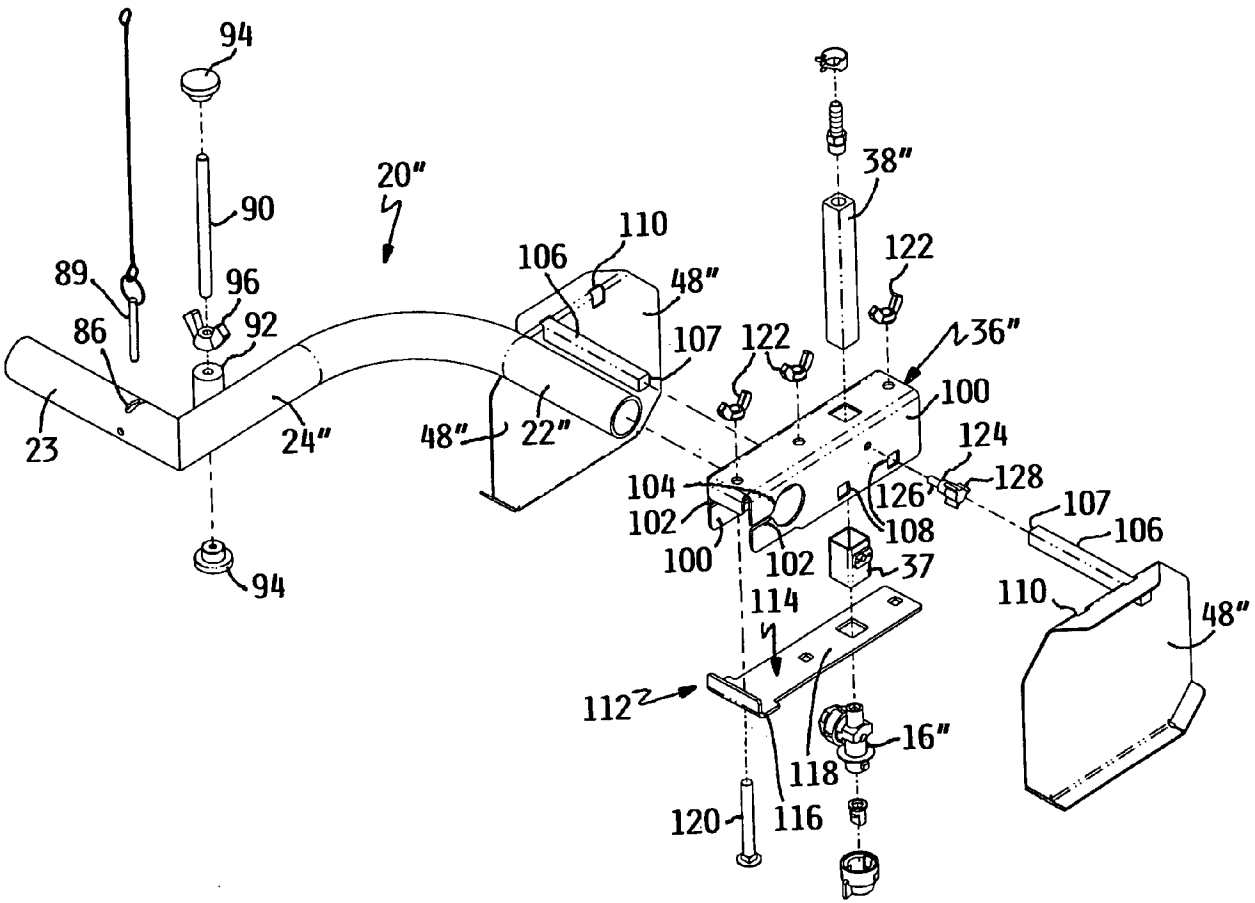
FIG. 13 is an exploded perspective view of a portion of the line marker of FIG. 8, particularly illustrating the outrigger arm, the spray nozzle, the mounting bracket for mounting the spray nozzle on the outrigger arm, and the side shields for confining the spray from the spray nozzle.

A pair of side shields 48" are adjustably secured to side walls 100 of mounting bracket 36". Each side shield 48" is formed with a transverse slide 106 fixed thereto. Each slide 106 on each shield 48" passes through a pair of aligned square apertures 108 formed on mounting bracket 36". FIG. 13 shows one aperture 108 in each pair, the other aperture 108 in each pair being similarly located on the other side wall 100 of mounting bracket 36" but being hidden from view in FIG. 13. As shown in FIG. 13, slide 106 on the outboard side shield 48" passes through the rear pair of apertures 108 while slide 106 on the inboard side shield passes 48" through the front pair of apertures 108. After passing through their respective pairs of apertures 108, the outer free ends 107 of each slide 106 will be aligned with a further aperture 110 provided therefor on the other side shield 48".

A clamp 112 is provided for clamping mounting bracket 36" on transverse leg 22" of outrigger arm 20" as well as for clamping side shields 48" in laterally adjusted positions on mounting bracket 36". Clamp 112 includes a clamping plate 114 having a first wider section 116 at one end and a narrower tongue 118. Wider section 116 of clamping plate 114 is wide enough to underlie the bottom edges of side walls 100 of mounting bracket 36" beneath split ends 102 thereof. Narrower tongue 118 of clamping plate 114 fits between side walls 100 of mounting bracket 36" and abuts against the underside of slides 106.

Clamp 112 also includes a plurality of threaded bolts 120. Bolts 120 extend up through clamping plate 114 and through various holes provided in the top of mounting bracket 36". A wing nut 122 is treaded onto the upper end of each bolt 120 to be able to tighten bolt 120 by drawing bolt 120 upwardly through wing nut 122. One such bolt 120 is shown in FIG. 13 with the other bolts 120 omitted from FIG. 13 for the purpose of clarity.

When wing nuts 122 are tightened on bolts 120, clamping plate 114 is forced upwardly towards the top wall of mounting bracket 36". Two things happen as a result. Wider section 116 of clamping plate 114 squeezes together split ends 102 of side walls 100 of mounting bracket 36" to clamp or secure mounting bracket 36" to transverse leg 22" of outrigger arm 20". Simultaneously, narrower tongue 118 of clamping plate 114 clamps each of slides 106 against the top of apertures 104 in side walls 100 of mounting bracket 36" to also clamp or secure side shields 48" to mounting bracket 36". Obviously, each side shield 48" is first slid to any desired position relative to mounting bracket 36" to adjust the width between side shields 48" before clamping plate 114 is clamped tightly against the bottom of mounting bracket 36".

The use of separate bolts 120 and wing nuts 122 on both wider section 116 and narrower tongue 118 of clamping plate 114 allows for release of split ends 102 without necessarily releasing the clamping force on slides 106 of side shields 48". For example, if the operator simply wishes to pivot mounting bracket 36" on transverse leg 22" without changing the position of side shields 48" on mounting bracket 36", only the wing nut 122 on bolt 120 passing through wider section 116 of clamping plate 114 need be loosened. The reverse is also true—the last two wing nuts 122 could be loosened separately from the first wing nut 122 to permit adjustment of side shields 48" without loosening the clamping force holding mounting bracket 36" on transverse leg 22". Obviously, clamping plate 114 could also be split into two separate clamping plates, i.e. a first plate corresponding to wider section 116 and a second plate corresposing to narrower tongue 118.

Spray nozzle 16" is carried on the lower end of a mounting arm 38" that passes downwardly through an aperture in the top of mounting bracket 36" and another aligned aperture in clamping plate 114. Mounting arm 38" also passes in a relatively close fit through an interior spacer 37 contained within mounting bracket 36". A rotatable set or thumb screw 124 has an inner end 126 that passes through one of side walls 100 of mounting bracket 36" and through an aperture in a near side wall of spacer 37 to engage against the side of mounting arm 38". When set screw 124 is tightened against mounting arm 38" by rotating a knob 128 located outside the side wall of mounting bracket 36", set screw 124 will hold mounting arm 38", and thus spray nozzle 16", in a vertically adjusted position relative to mounting bracket 36" by holding mounting arm 38" against the far side wall of spacer 37.

Preferably, mounting arm 38" comprises a hollow tube to also serve as a conduit for the flow of marking liquid to spray nozzle 16". However, this is not necessary. Mounting arm 38" could be solid with another fluid flow conduit used to carry marking liquid to spray nozzle 16".

Figure 14:
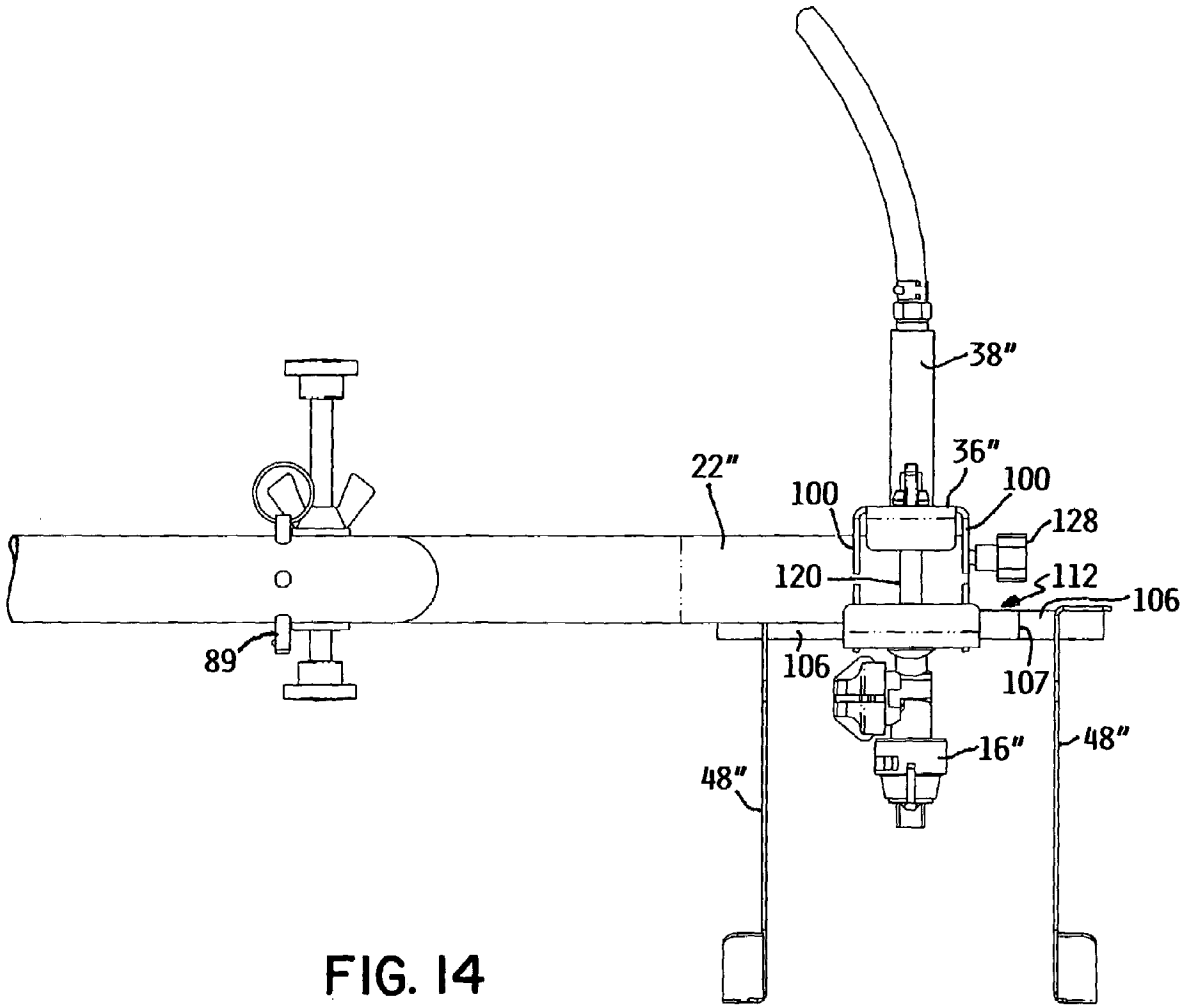
FIG. 14 is a front elevational view of what is shown in FIG. 13, particularly illustrating the spray nozzle and side shields having been adjusted to spray a relatively wider line.
Figure 15:
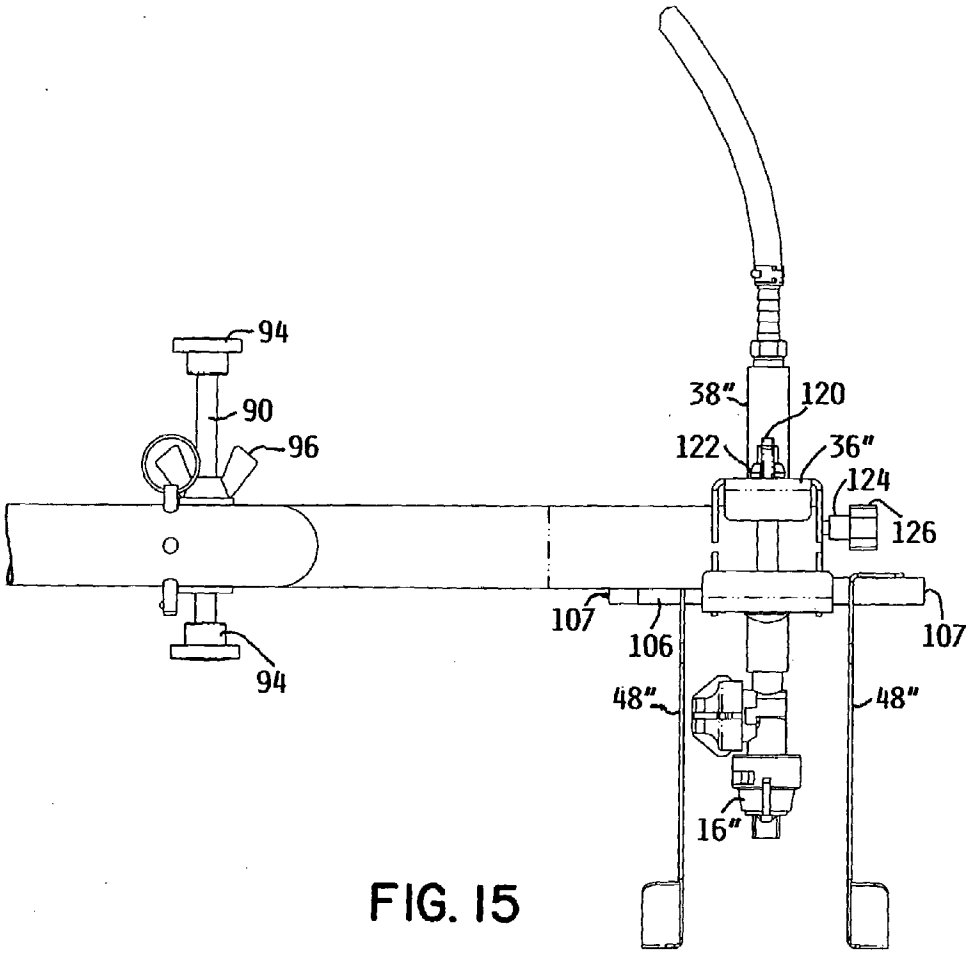
FIG. 15 is a front elevational view similar to FIG. 14, particularly illustrating the spray nozzle and side shields having been adjusted to spray a line that is narrower than the line being sprayed in FIG. 14.

FIGS. 14 and 15 show different adjusted positions for spray nozzle 16" and side shields 48" to spray lines of different width. Desirably, the spacing between side shields 48" is set in relation to the height of spray nozzle 16" so that the fan shaped spray from spray nozzle 16" spreads out laterally to just cover the distance between side shields 48" at the lower edge of side shields 48". In FIG. 14, spray nozzle 16" is raised on mounting bracket 36" and side shields 48" are slid apart on mounting bracket 36" to spray a wider line. Conversely, in FIG. 15, spray nozzle 16" is lowered on mounting bracket 36" and side shields 48" are slid towards one another on mounting bracket 36" to spray a narrower line. Once spray nozzle 16" and side shields have been adjusted to provide a line of desired width, transverse leg 22" of outrigger arm 20" can be vertically adjusted upwardly and downwardly as previously described to place such a line onto planes at different elevations relative to the ground, i.e. either at ground level or at planes above ground level.

Line marker 2" includes a sight guide 40" comprising a laterally extending arm 44" carried on the front of frame 4" for pivoting about a substantially vertical pivot 43. A wing nut 130 is provided for locking arm 44" in place on vertical pivot 43. Arm 44" includes a telescopically adjustable L-shaped outer arm portion 132 having a vertical leg 134. Again, a thumb or set screw 136 locks outer arm portion 132 in any desired extended position relative to frame 4" to control how far vertical leg 134 of outer arm portion 132 extends beyond the side of frame 4". A ski-shaped skid 80" is vertically adjustable on the lower end of vertical leg 134 of sight guide 40".

In using line marker 2" shown in FIGS. 8–24, the operator first sets or adjusts spray nozzle 16" and side shields 48" to mark a line of desired width at the bottom of side shields 48". Then, the operator also adjusts the vertical height of outrigger arm 20" above the ground so as to place the marked line at a nominal desired height, i.e. at ground level when marking a paved surface or a few inches above the ground when marking the top of a mowed grass surface. Sight guide 40" is also adjusted by aligning one edge or the other of skid 80" with one side of the line that is to be marked or with a string outlining such a side.

With line marker 2" so configured, the operator can then walk behind line marker 2" as spray is being delivered through spray nozzle 16" downwardly to mark the line. As in line marker 2" of the first embodiment, spray nozzle 16" is in a rear spray position that is preferably substantially aligned with (i.e. on or within a few inches either fore or aft of) the rotational axis of rear wheels 8". Thus, any steering mistakes made by the user when guiding line marker 2", or any steering movements needed to correct such mistakes, will not cause spray nozzle 16" to deviate very much from the desired path of the line. This results in a straighter, less wavy line for the reasons enumerated earlier.

In some operational situations, having spray nozzle 16" located in a rear spray position on frame 4" is not optimum. For example, assume line marker 2" needs to mark a line all the way up to a fixed object such as a curb or the side of a building. When front wheel 6" of line marker 2" hits such a fixed object, spray nozzle 16" in its rear spray position will still be located well short of the fixed object. Thus, line marker 2" is unable to mark the line all the way up to the fixed object. This is not desirable.

Figure 18:
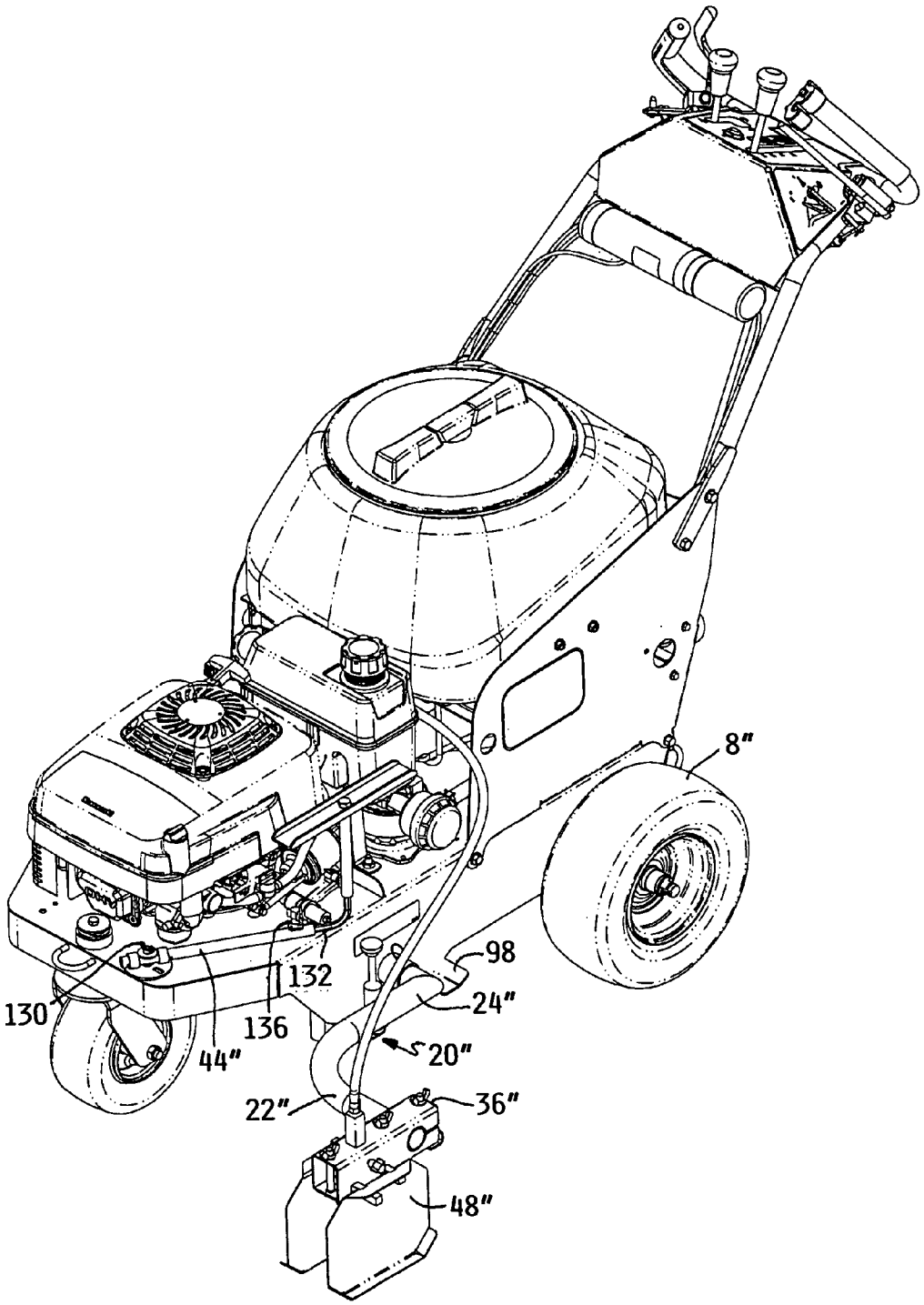
FIG. 18 is a front perspective view of the line marker shown in FIG. 8, particularly illustrating the outrigger arm and spray nozzle adjacent the left side of the line marker in a front spray position.
Figure 19:
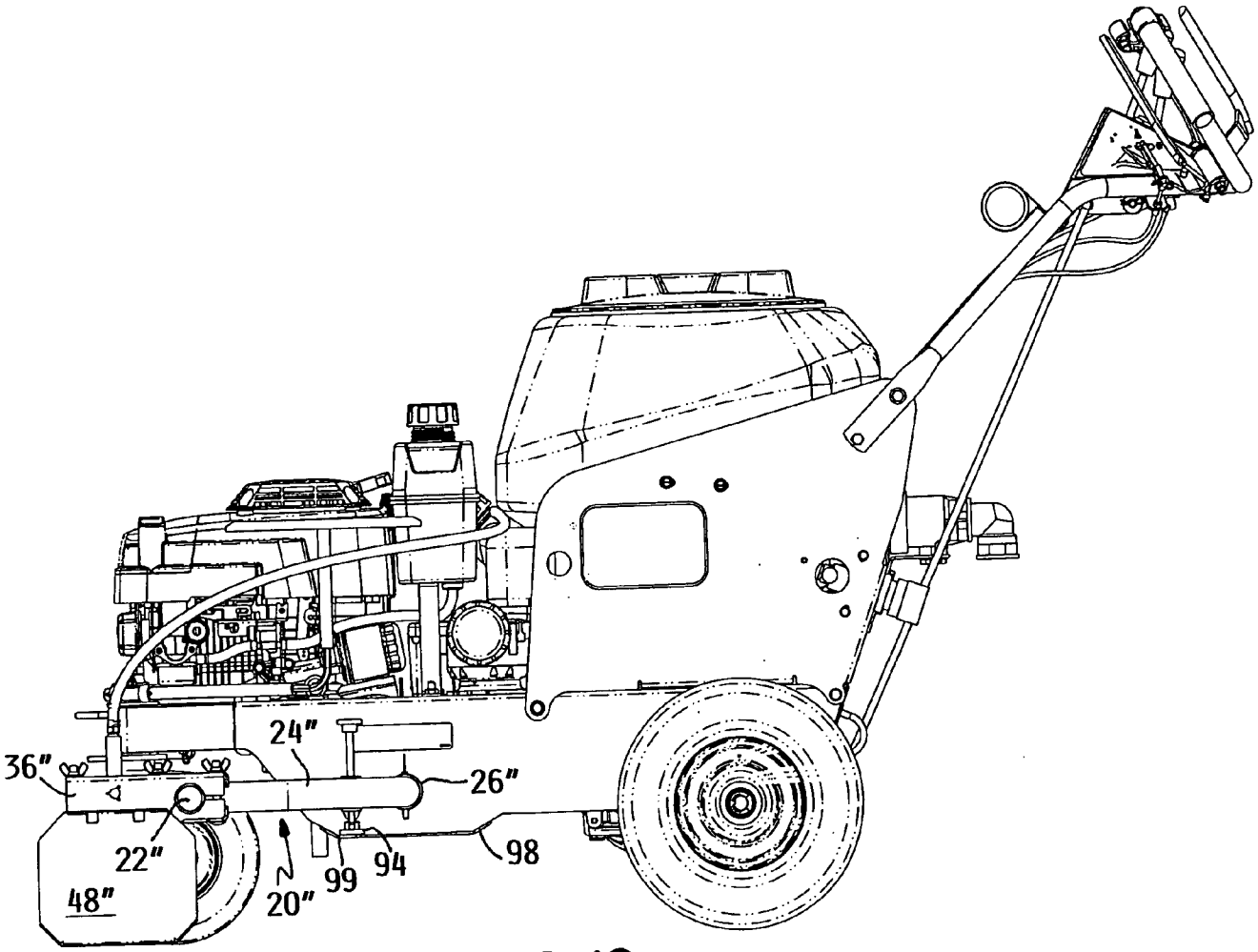
FIG. 19 is a side elevational view of the line marker configured in the front spray position shown in FIG. 18.

In such operational situations, line marker 2" of this invention is designed to allow outrigger arm 20" to be flipped over 180° such that longitudinal leg 24" of outrigger arm 20" now extends forwardly on frame 4" from pivot hub 26" rather than rearwardly. Mounting bracket 36" for spray nozzle 16" is also removed and reinstalled on transverse leg 22" of outrigger arm 20" so that mounting bracket 36" extends forwardly from transverse leg 22" with spray nozzle 16" pointing downwardly towards the ground. When this is done, spray nozzle 16" will be located substantially even or slightly ahead of the front end of frame 4". The front spray position of spray nozzle 16" allows a line to be marked all the way up to a fixed object. FIGS. 18 and 19 show the front spray position of spray nozzle 16".

Obviously, the usual location of sight guide 40" prevents spray nozzle 16" from being placed in the front spray position. However, sight guide 40" is designed to move out of the way to permit such placement. Set screw 136 can be loosened to allow L-shaped outer arm portion 132 to be telescoped into arm 44" and to be rotated approximately 180° so that vertical leg 134 now points upwardly instead of downwardly. Then, wing nut 130 can be loosened to allow arm 44" to pivot rearwardly about its vertical pivot 43. This permits sight guide 40" to swing rearwardly until L-shaped outer arm portion 132 and skid 80" are nested along and above one side of frame 4" closely adjacent the engine. See FIG. 18 or 19. This clears the space that is to be occupied by spray nozzle 16" in its front spray position. Moreover, side shields 48" on mounting bracket 36" can function as sight guides in the front spray position so that sight guide 40" is no longer needed.

A front stop 99 similar to rear stop 98 is provided on the side of frame 4" to cooperate with the other head 94 of height adjustment rod 90, i.e. with what was the upper unused head 94 when spray nozzle 16" was in its rear spray position. When outrigger arm 20" is flipped over and placed into the front spray position, what was the upper head of rod 90 becomes lower head 94 and now cooperates with front stop 99. Thus, outrigger arm 20" can still be pivoted within pivot hub 26" in the same manner as before to raise or lower the height of spray nozzle 16" above the ground.

In some cases, it may be desirable to locate outrigger arm 20", spray nozzle 16" and sight guide 40" on the other side of line marker 2". For example, if a line is to be marked that is parallel to and close to the side of a building which must be approached with the right side of line marker 2" adjacent the building, then spray nozzle 16" would have to be positioned on the right side of frame 4" as opposed to the left side of line marker 2". Thus, a second pivot hub 26", another pair of stops 98 and 99, and another mount for sight guide 40" are provided on the opposite side of frame 4". This allows alternate placement of outrigger arm 20", spray nozzle 16" and sight guide 40" on the opposite side of frame 4". See FIG. 20 which shows such alternate placement.

Figure 21:
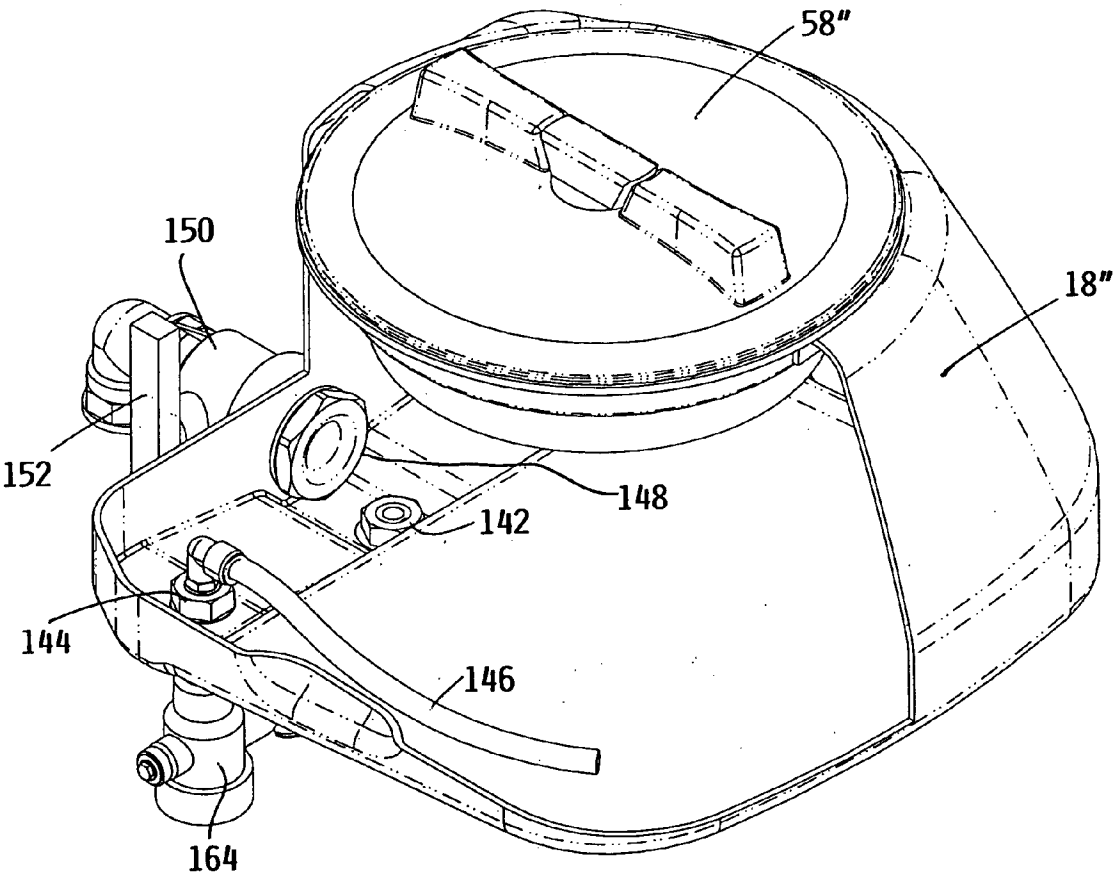
FIG. 21 is a perspective view of the marking liquid reservoir of the line marker shown in FIG. 8, with a portion of the reservoir being broken away to show a reservoir hose as it would be disposed inside the reservoir while operating in a marking mode.
Figure 22:
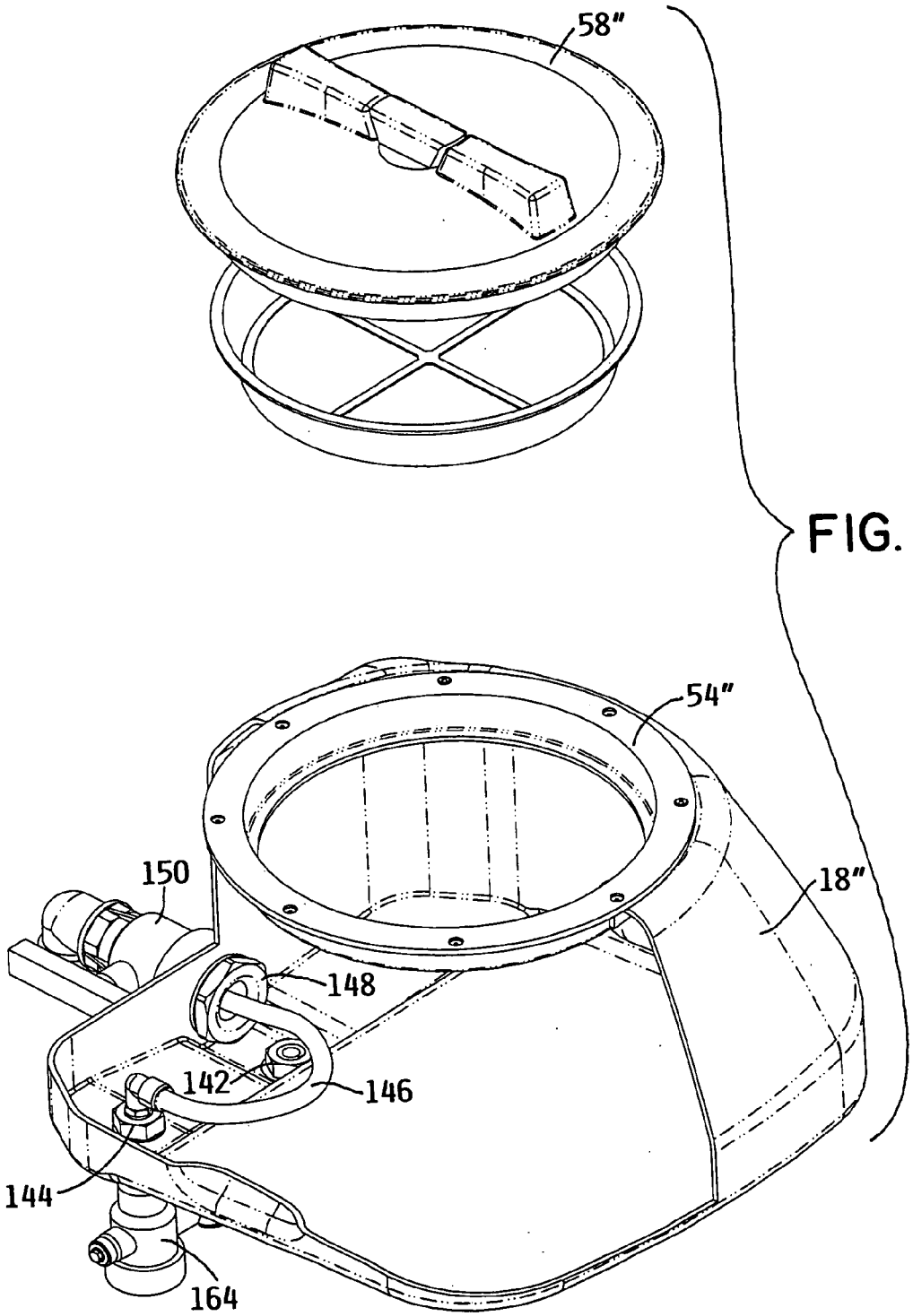
FIG. 22 is a perspective view similar to FIG. 21, but showing the reservoir hose as it would be disposed inside the reservoir while operating in a clean out mode.

Line marker 2" is provided with a hydraulic circuit 140 that includes a reservoir 18" for holding a supply of the marking liquid. Reservoir 18" is shown in FIGS. 21 and 22 with a portion of reservoir 18" being broken away to show the interior of reservoir 18". Reservoir 18" has an upper fill inlet 54" normally closed by a lid or cover 58". The operator can remove lid or cover 58" and pour marking liquid into reservoir 18" through fill inlet 54".

Reservoir 18" has two fittings in the bottom thereof. The first fitting is a reservoir outlet 142 located at the lowest point on reservoir 18" for taking and using the marking liquid from reservoir 18". The second fitting is a reservoir inlet 144 for pumping a liquid, either the marking liquid or a cleaning liquid, into reservoir 18", as will be explained in more detail hereafter. A short length of flexible reservoir hose 146 may be connected to the reservoir inlet 144 to help direct such liquid into or through reservoir 18", again as will be explained in more detail later.

In addition to the two fittings provided in the bottom of reservoir 18", a third fitting is provided in a rear wall of reservoir 18". This third fitting is an additional reservoir outlet 148 and is also provided at or adjacent the lowest point of reservoir 18". Reservoir outlet 148 leads to a manually operable drain valve 150 on the rear of reservoir 18". Drain valve 150 has an operating handle 152 to allow the operator to manually open and close drain valve 150. When drain valve 150 is open, any liquid contained in reservoir 18" will drain through reservoir outlet 148.

Figure 11:
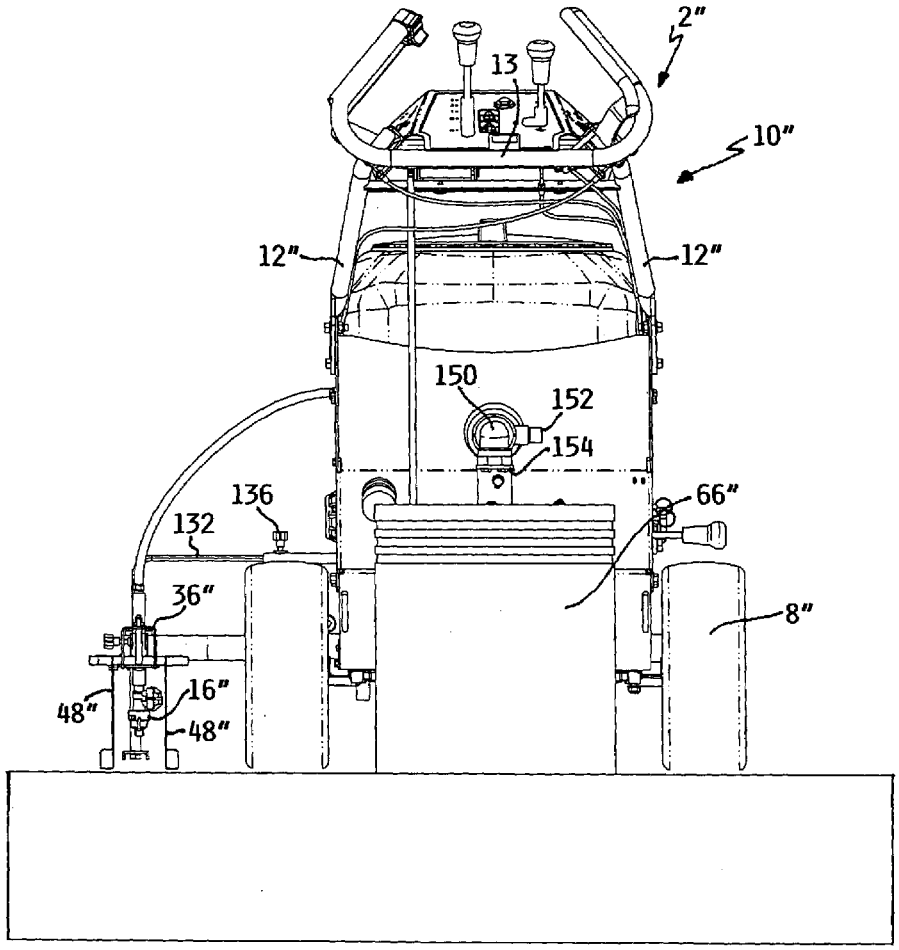
FIG. 11 is a rear elevational view of the line marker of FIG. 8, particularly illustrating a five gallon paint bucket positioned beneath the rear of the marking liquid reservoir to receive unused marking liquid from the reservoir.
Figure 12:
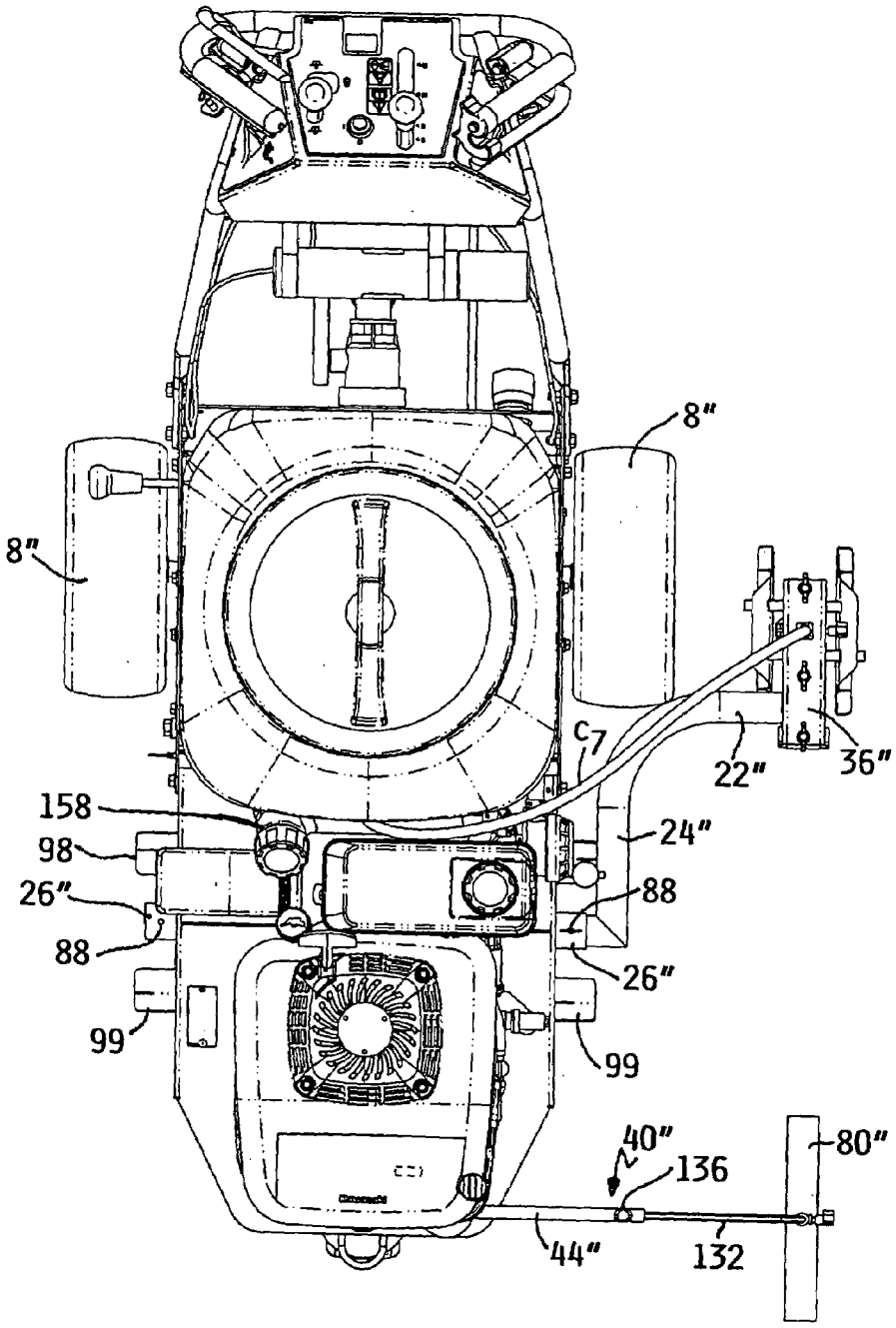
FIG. 12 is a top plan view of the line marker of FIG. 8.

As in line marker 2" of the second embodiment, drain valve 150 connected to reservoir 18" has a drain outlet 154 that is high enough to be placed above the rim of a standard 5 gallon paint bucket 66". This is shown in FIG. 11. Thus, outlet 154 of drain valve 150 is at least approximately 15"

above the ground. It may also be higher than 15" as shown in FIG. 11 where outlet 154 is located a few inches above the rim of paint bucket 66". Thus, line marker 2" can conveniently and advantageously drain unused marking liquid back into paint bucket 661" merely by opening drain valve 150.

Line marker 2" also includes a tank 156 for holding a supply of flush water. Water tank 156 is positioned beneath reservoir 18". Water tank 156 has a removable cap 158 to allow water tank 156 to be filled with water. Thus, line marker 2" carries a sufficiently large onboard supply of water to flush hydraulic circuit 140 of line marker 2".

Figure 23:
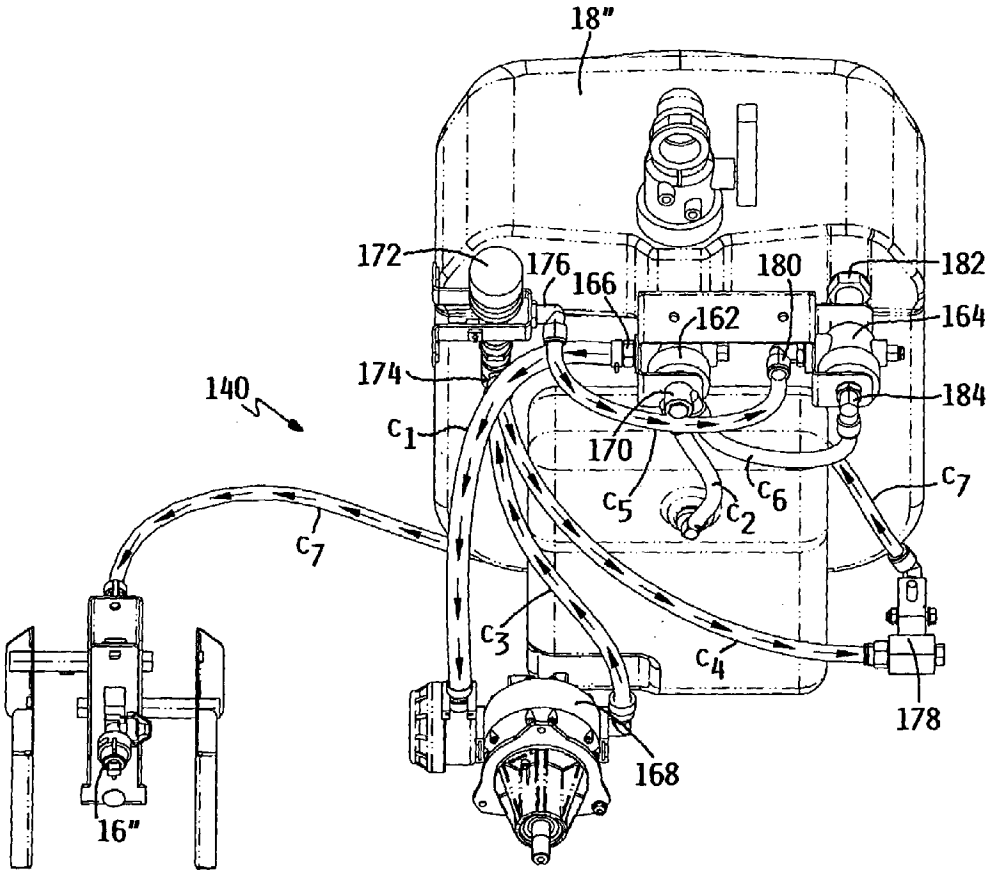
FIG. 23 is a perspective view of the hydraulic circuit of the line marker shown in FIG. 8, particularly illustrating fluid flow while the hydraulic circuit is operating either in a marking mode or a clean out mode.
Figure 24:
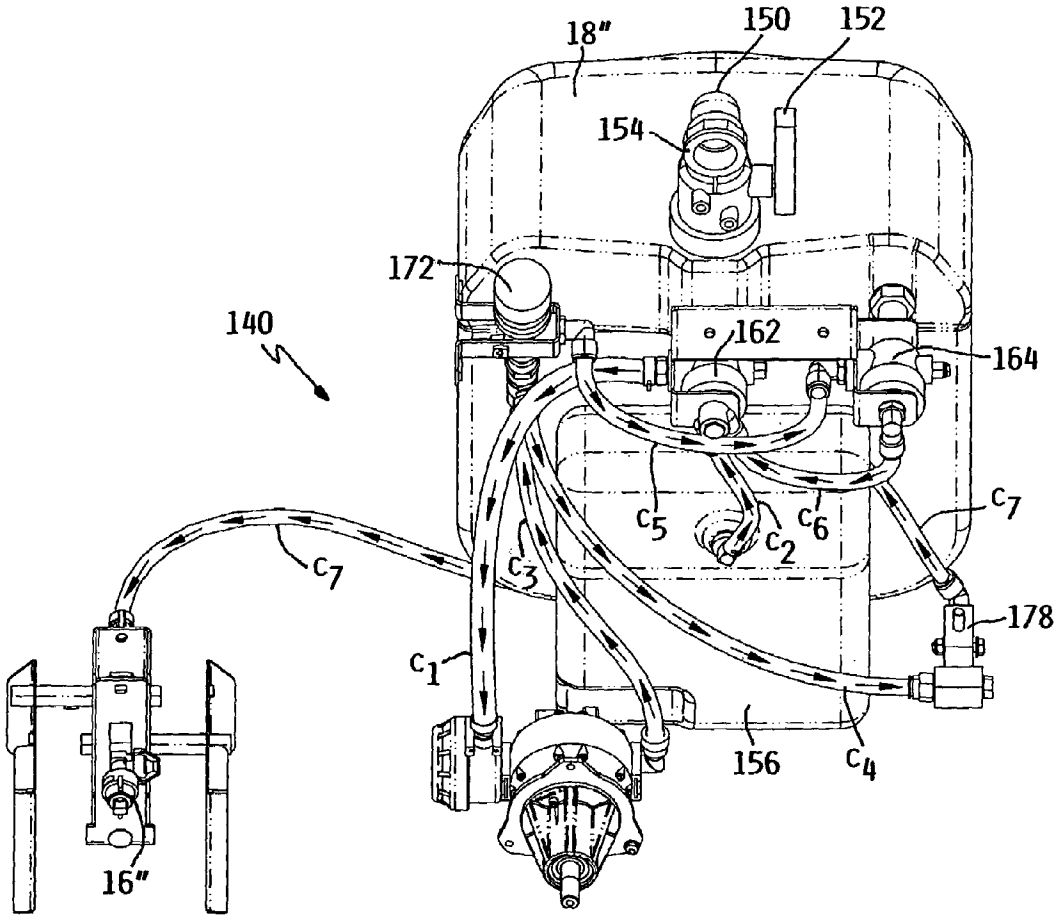
FIG. 24 is a perspective view similar to FIG. 23, particularly illustrating fluid flow while the hydraulic circuit is operating in a flush mode.

As shown in FIGS. 23 and 24, hydraulic circuit 140 includes a pair of interlinked liquid flow control valves beneath the bottom of reservoir 18". These valves comprise an outlet valve 162 connected to reservoir outlet 142 (i.e. to the first fitting of reservoir 18") and an inlet valve 164 connected to reservoir inlet 144 (i.e. to the second fitting of reservoir 18").

Outlet valve 162 has a single, continuously open outlet port 166 connected by a first conduit $c_1$ to the inlet of a pump 168. In addition, outlet valve 162 has two inlet ports for receiving liquid. One inlet port (not shown) of outlet valve 162 is connected directly to reservoir outlet 142 to be able to pump marking liquid out of reservoir 18". The other inlet port 170 of outlet valve 162 is connected by a second conduit $c_2$ to water tank 156 to be able to pump water out of water tank 156. Outlet valve 162 can be selectively shifted by the operator to employ one inlet port or the other at a time, namely outlet valve 162 can be selectively adjusted to pump marking liquid out of reservoir 18" or water out of water tank 156 but does not pump both liquids simultaneously. Outlet valve 162 has a third position in which both inlet ports are closed so that the no liquid can be drawn from either reservoir 18" or water tank 156.

The outlet of pump 168 is connected by a third conduit $c_3$ to the inlet of a pressure regulator 172. Pressure regulator 172 has two continuously open outlet ports 174 and 176. One outlet port 174 of pressure regulator 172 is connected by a fourth conduit $c_4$ to the inlet of a spray nozzle control valve 178. The other outlet port 176 of pressure regulator 172 is connected by a fifth conduit $c_5$ to an inlet port 180 of inlet valve 164.

Inlet valve 164 has two outlet ports. One outlet port 182 of inlet valve 164 is connected directly to reservoir inlet 144. The other outlet port 184 of inlet valve 164 is connected by a sixth conduit $c_6$ back to that inlet port 170 of outlet valve 162 which receives water from water tank 156. Inlet valve 164 is selectively opened or closed by the operator in concert with the operation of outlet valve 162 such that any liquid entering inlet valve 164 is either directed into reservoir 18" or is alternatively sent back to outlet valve 162 through conduit $c_6$. Like outlet valve 162, inlet valve 164 has a third position in which all flow is shut off through inlet valve 164.

Figure 8:
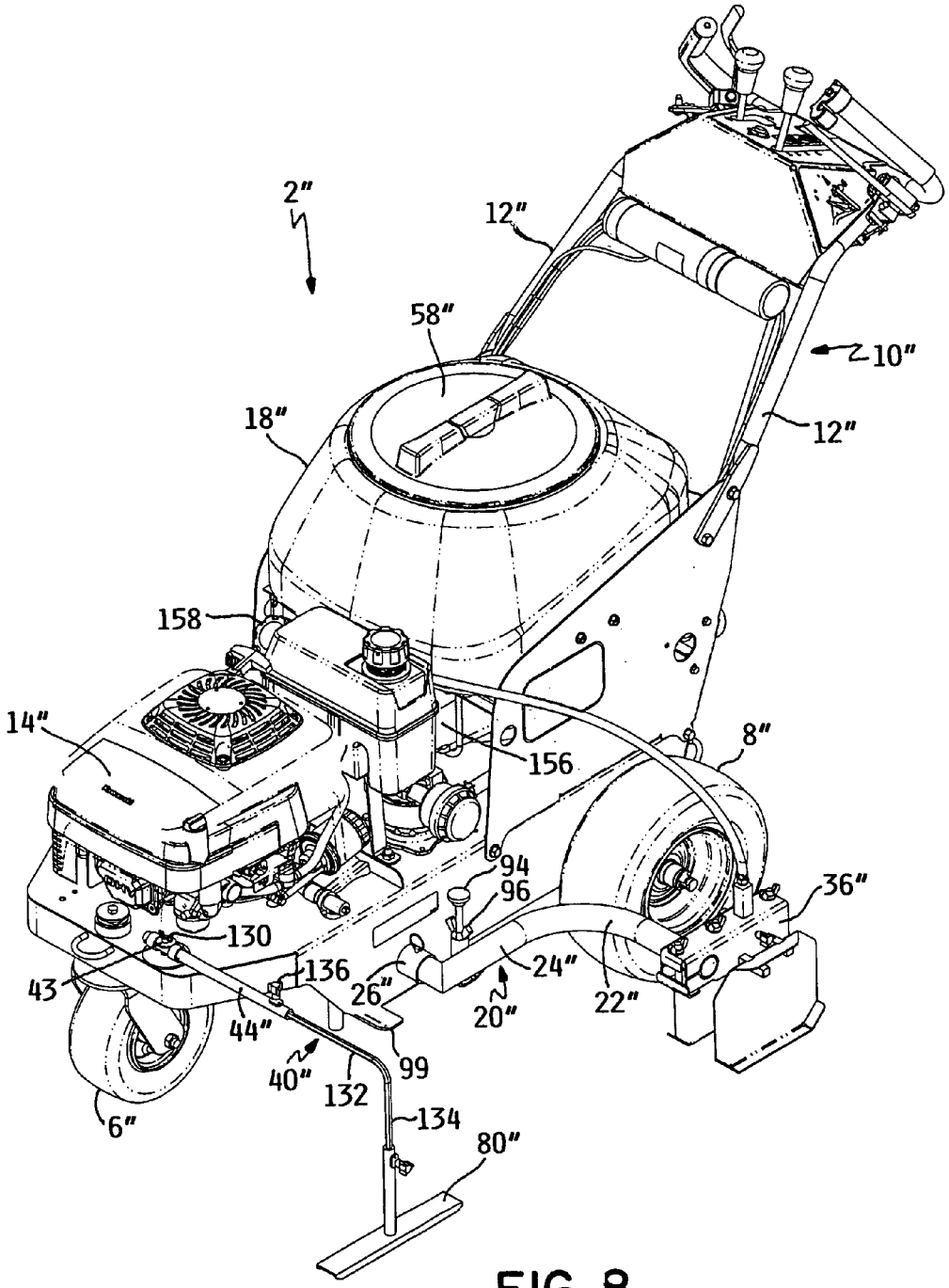
FIG. 8 is a front perspective view of a walk behind line marker according to a third embodiment of this invention, particularly illustrating the outrigger arm and spray nozzle adjacent the left side of the line marker in a rear spray position.
Figure 9:
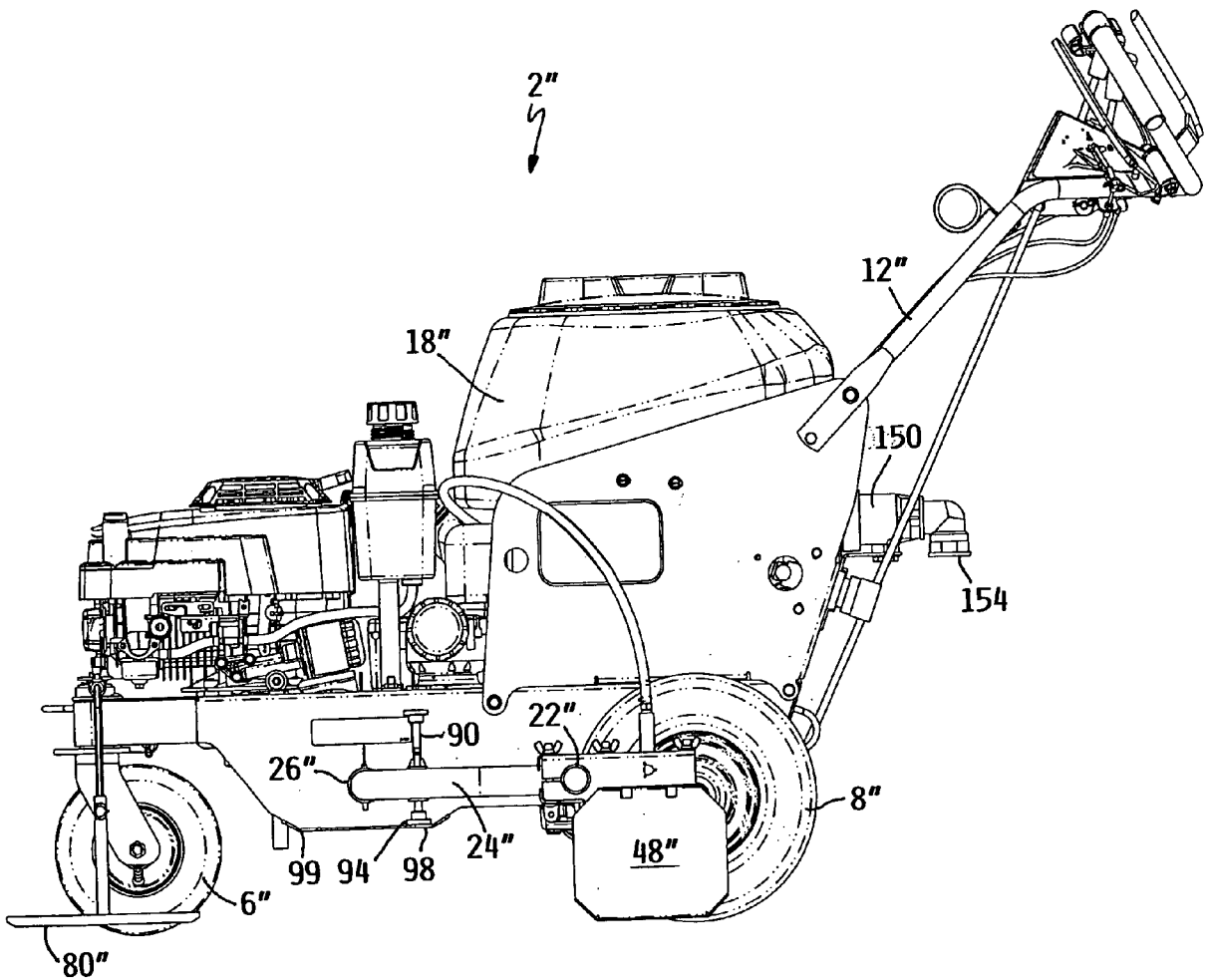
FIG. 9 is a left side elevational view of the line marker of FIG. 8.
Figure 10:
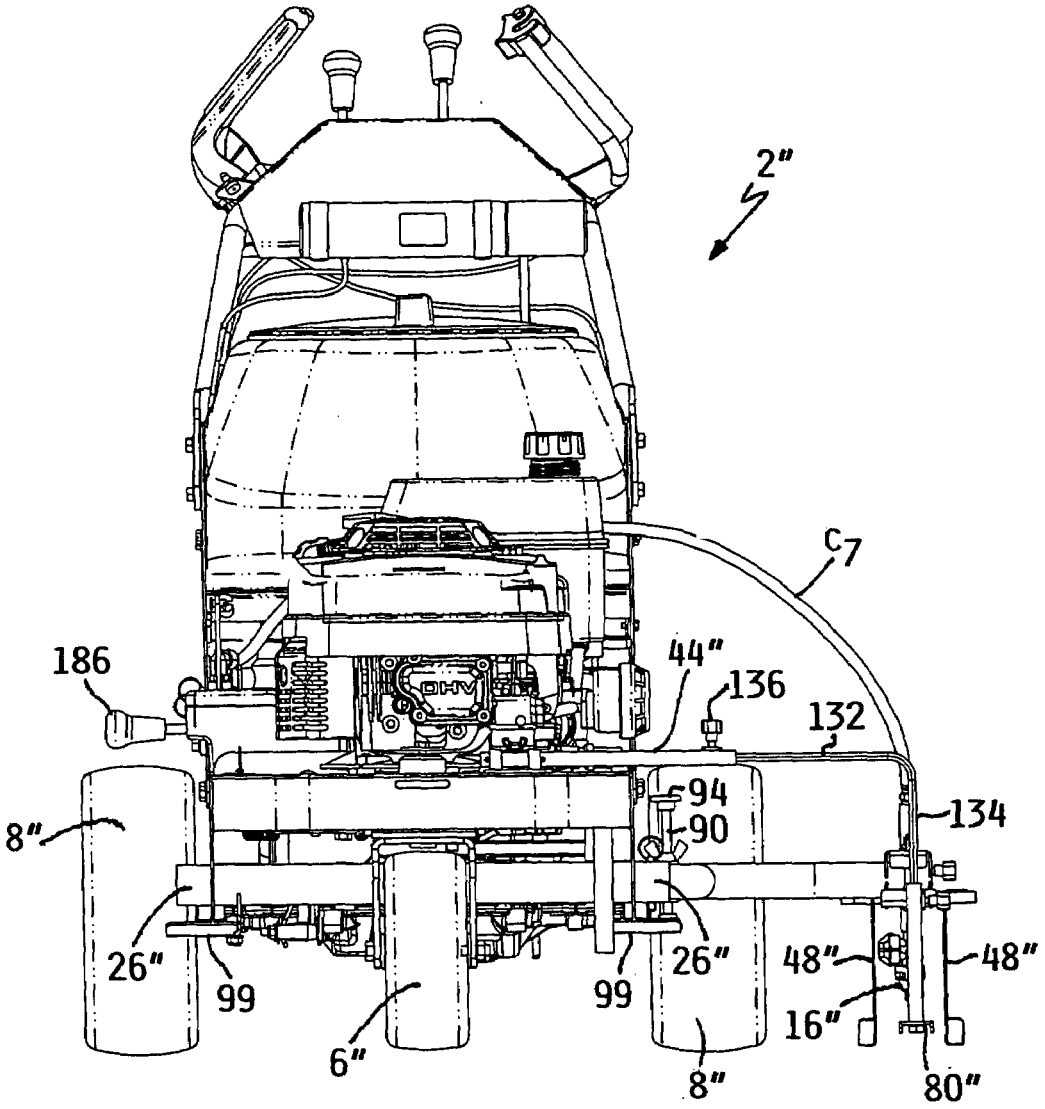
FIG. 10 is a front elevational view of the line marker of FIG. 8.
Figure 20:
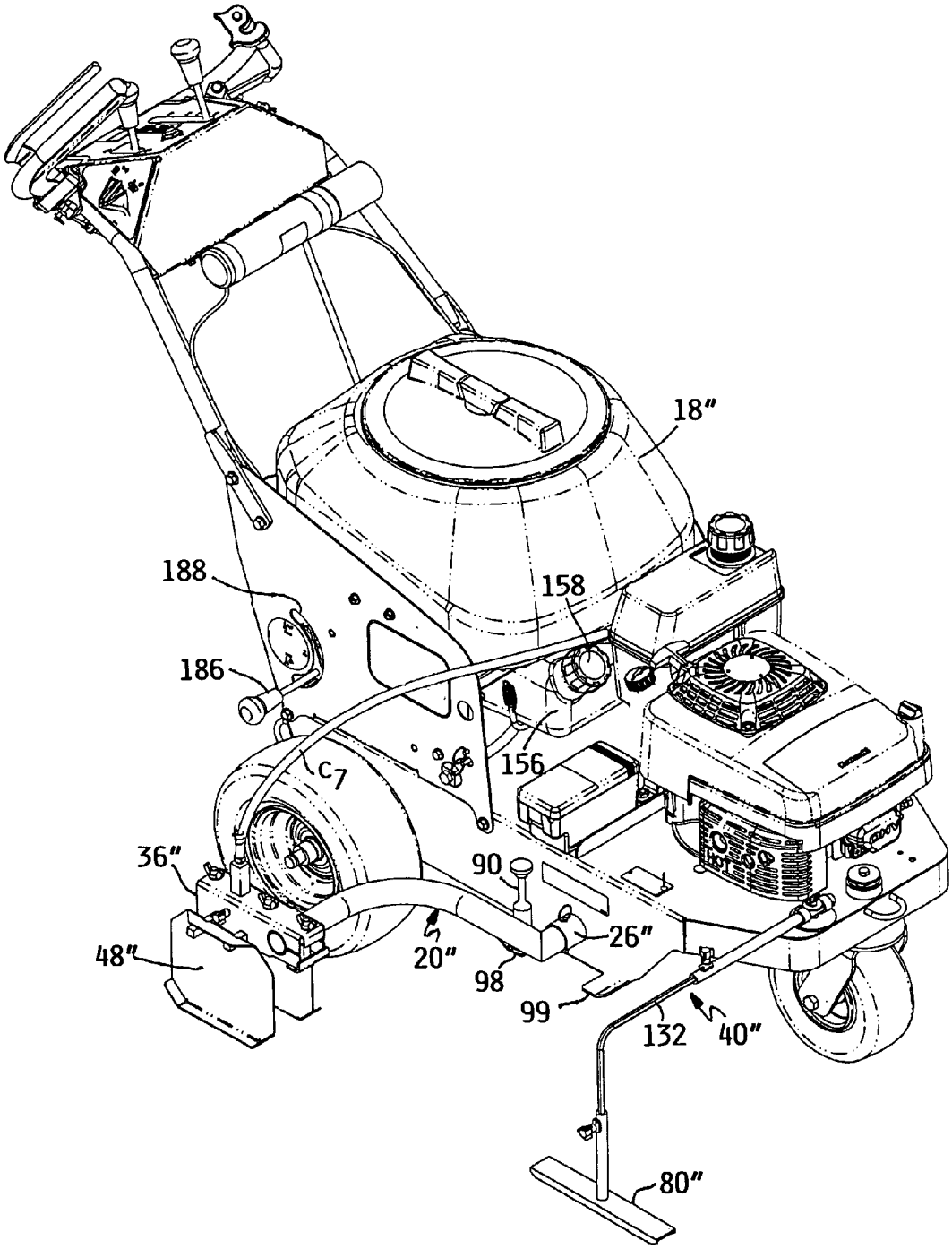
FIG. 20 is a front perspective view of the line marker shown in FIG. 8, particularly illustrating the sight guide, outrigger arm and spray nozzle adjacent the right side of the line marker.

A seventh conduit $c_7$ connects the outlet of spray nozzle control valve 178 to spray nozzle 16" itself. Obviously, conduit $c_7$ is long and flexible enough to accommodate the three different operational positions of spray nozzle 16" on frame 4" of line marker 2" as shown in FIGS. 8, 18, and 20. The operator can selectively open or close spray nozzle control valve 178 by any suitable control mechanism or linkage that is accessible to the user.

Outlet valve 162 and inlet valve 164 have previously been described as being interlinked. A control mechanism including a control handle 186 is linked to both of the valves. Control handle 186 extends out through an arcuate slot 188 provided therefor in one side of line marker 2" to be accessible to the user. See FIG. 20. Control handle 186 can be moved around the length of slot 188 to select various modes of operation of hydraulic circuit 140.

When control handle 186 is located in a first position in slot 188, hydraulic circuit 140 is in an "off" mode such that both valves 162 and 164 are closed so that no liquid can pass through either valve. When control handle 186 is located in a second position in slot 188, hydraulic circuit 140 is in a "marking" mode (or in a "clean out" mode) in which liquid can flow out of reservoir 18" through outlet valve 162 and into reservoir 18" through inlet valve 164. When control handle 186 has been moved to a third position in slot 188, hydraulic circuit 140 is in a "flush" mode in which liquid can flow out of water tank 156 through outlet valve 162 and through inlet valve 164 in a loop back to outlet valve 162 but not into reservoir 18".

Turning now to the operation of hydraulic circuit 140 in its "marking" mode, the flow in hydraulic circuit 140 is as shown in FIG. 23. With pump 168 running, marking liquid is pumped out of reservoir 18" through outlet valve 162, through pump 168, and to pressure regulator 172. From pressure regulator 172, at least some of the marking liquid is recirculated back into reservoir 18" through inlet valve 164 and another portion of the marking liquid will be made available to spray nozzle 16". However, unless spray nozzle control valve 178 is also opened, no marking liquid will reach spray nozzle 16" and there will be no flow in conduit $c_7$. In this event, all of the marking liquid being pumped is in effect continuously recirculating through reservoir 18".

Recirculating the marking liquid back through reservoir 18" is desirable to keep the marking liquid in an agitated, fully mixed state. This is enhanced by the short length of reservoir hose 146 provided inside reservoir 18" connected to reservoir inlet 144. See FIG. 21. When this reservoir hose 146 extends and curves over at least a portion of the bottom or reservoir 18", as shown in FIG. 21, reservoir hose 146 increases the agitation provided by the recirculated marking liquid over what would occur if reservoir inlet 144 had no such reservoir hose 146 attached thereto.

With hydraulic circuit 140 in its "marking" mode and marking liquid being pumped as described above, the operator can selectively start and stop the actual marking of a line by opening and closing, respectively, spray nozzle control valve 178. When spray nozzle control valve 178 is open, the marking liquid can then also pass through conduit $C_7$ to spray nozzle 16". Spray nozzle 16" than sprays such marking liquid downwardly to mark a line. While the flow capacity of spray nozzle 16" could equal or exceed the pumping capacity of pump 168, desirably the flow capacity of spray nozzle 16" is substantially less than the pumping capacity of pump 168 (e.g. ½ gpm spray nozzle capacity vs 4 gpm pump capacity). Thus, a majority of the marking liquid is still recirculated through reservoir 18" even when marking liquid is actually being sprayed from spray nozzle 16" during a line marking operation.

There will be times when hydraulic circuit 140 of line marker 2" is desirably flushed to prevent the various components thereof from clogging with dried or partially dried marking liquid. For example, a flush of hydraulic circuit 140 should be done prior to any extended period of inactivity of line marker 2", such as when the operator of line marker 2" temporarily discontinues work and takes a break. Such a flush can be particularly easily and expeditiously accompanied by line marker 2" of this invention when hydraulic circuit 140 is in the flush mode.

Turning now to the operation of hydraulic circuit 140 in its "flush" mode, the flow in hydraulic circuit 140 is as shown in FIG. 24. With pump 168 running, water is pumped out of water tank 156 through outlet valve 162, through pump 168, and to pressure regulator 172. From pressure regulator 172, at least some of the water is recirculated through inlet valve 164 and then passes back to outlet valve 162 without entering reservoir 18". Another portion of the water will pass from pressure regulator 172, through spray nozzle control valve 178, and then through spray nozzle 16", at least when spray nozzle control valve 178 is open. Thus, in the flush mode, water is taken from water tank 156 and circulated through all the components of hydraulic circuit 140, save for reservoir 18", as well as the connecting conduits before finally exiting through spray nozzle 16".

The operator can perform such a flush operation after first disconnecting outrigger arm 20" from frame 4" of line marker 2". This can be done by pulling lock pin 89 out of pivot hub 26" and by then sliding stub shaft portion 23 of longitudinal leg 24" of outrigger arm 20" out of pivot hub 26". With outrigger arm 20" disconnected, the operator can then lift lid or cover 58" off reservoir 18" and point spray nozzle 16" so that the spray therefrom will pass downwardly into reservoir 18" through fill inlet 54".

The operator can then operate hydraulic circuit 140 in its flush mode as described earlier. As water is pumped out of water tank 156, the water will push the marking liquid ahead of it to first purge hydraulic circuit 140 of such marking liquid. Thus, during the initial purge portion of a flush operation, substantially undiluted marking liquid will first exit from spray nozzle 16" and fall back down through fill inlet 54" of reservoir 18" to rejoin the marking liquid contained in reservoir 18". By observing the character of the spray from spray nozzle 16" as spray nozzle 16" is held over fill inlet 54" of reservoir 18", the operator can tell when the water begins to pass through spray nozzle 16" since the spray will become lighter or more transparent as the marking liquid begins to mix with the water at the end of the initial purge of the marking liquid. The operator then ends the flush operation at this point. As a result, hydraulic circuit 140 has been flushed to clear the valves 162, 164 and 178, pump 168, pressure regulator 172, the conduits, etc. of marking material, the purged marking material has been returned to reservoir 18", but no significant amounts of water have been put into reservoir 18".

Obviously, hydraulic circuit 140 of line marker 2" of this invention can be easily flushed and cleaned at almost any place and time, even periodically over the course of a day while line marker 2" is far from a maintenance facility. There is no need to have a supply of water on hand since line marker 2" carries its own onboard supply of flush water. There is no need to disassemble or disconnect the various components of the hydraulic system from each other to operate in the flush mode. All that must be done is to place control handle 186 in the position corresponding to the flush mode, which shifts the interlinked outlet and inlet valves 162 and 164 as described above, and then to operate pump 168. Even outrigger arm 20" is easily removable from frame 4" of line marker 2" to allow spray nozzle 16" to be held over fill inlet 54" of reservoir 18" during operation in the flush mode to return purged marking liquid to reservoir 18". Thus, hydraulic circuit 140 can be flushed with a minimum of effort and mess which is an improvement over the prior art.

There will be times when hydraulic circuit 140 of line marker 2" is desirably cleaned out more completely following a flush operation. This might be done at the end of the day or at a time when use of line marker 2" is being discontinued for an extended period of time. In the clean out mode, reservoir 18" is desirably emptied or drained of unused marking liquid and reservoir 18" itself is flushed or cleaned to remove any residue of the marking liquid.

In order to perform a clean out operation, the operator might first flush hydraulic circuit 140 as described above in connection with the flush mode of operation. However, this flush step is not essential as the first step in a clean out operation and could be dispensed with if so desired.

In every clean out operation, one step that will be performed is to drain any unused marking liquid from reservoir 18". This is done by placing a standard 5 gallon paint bucket 66" beneath outlet 154 of drain valve 150 on reservoir 18". When drain valve 150 is manually opened by the operator, any marking liquid left in reservoir 18" will drain out of reservoir 18" through drain outlet 154 and into paint bucket 66". When the draining operation is complete, the lid of paint bucket 66" can be put back on paint bucket 66" and the unused marking liquid will be conveniently stored in its usual container for reuse at a future time.

After the unused marking liquid has been drained from reservoir 18", the operator may then open reservoir 18" by lifting lid or cover 58" off fill inlet 54" of reservoir 18". The operator may then manually redirect reservoir hose 146 into reservoir outlet 148 at the rear of reservoir 18". See FIG. 24. Such an orientation of reservoir hose 146 is preferred when hydraulic circuit 140 is placed into its "clean out" mode.

With reservoir hose 146 in the position shown in FIG. 24, the operator may then place control handle 186 to select the marking mode of operation as described earlier. The operator will also then place an external water hose (not shown) into reservoir 18" through the open fill inlet 54". The external water hose will be connected to a water tap or spigot connected to a high capacity external water source, such as a city water main. The operator will then direct a constant stream of water from this external water source into reservoir 18" using the external water hose to wash out the various interior walls of reservoir 18".

As the operator washes out reservoir 18" and with pump 168 running, the water passing into reservoir 181" from this external hose will quickly be pumped out of reservoir 18" by operation of hydraulic circuit 140 in the "marking" mode of FIG. 24. This water after passing through hydraulic circuit 140 will then be returned to reservoir 18" through reservoir hose 146 connected to reservoir inlet 144. However, since reservoir hose 146 has desirably been redirected into the open drain valve 150, this water will simply be dumped out of reservoir 18" through drain valve 150. During this type of operation in the clean out mode, line marker 2" will be positioned at a maintenance facility or the like where the water being dumped from drain valve 150 can be directed to a suitable disposal location, i.e. either a floor drain connected to a sewer system where this is permitted or some type of holding tank for containing paint based waste.

As in the case of operation in the flush mode, hydraulic circuit 140 can be easily drained of unused marking material and then completely cleaned without having to disassemble or disconnect the components thereof. Reservoir hose 146 in reservoir 18" is desirably redirected into reservoir outlet 148 leading to drain valve 150, but this is easy to do. The operator must have on hand an external water hose and an external source of water to provide a sufficient volume of water for clean out, but these will be available to most operators of this type of equipment at their maintenance facilities. Hydraulic circuit 140 is then simply operated in the marking mode to discharge the clean out water through reservoir hose 146 in reservoir 18". Thus, the hydraulic flow in hydraulic circuit 140 of this invention is essentially the same in the marking mode or the clean out mode.

The marking liquid which is pumped and sprayed in line markers 2, 2' preferably comprises a paint, i.e. a liquid containing a pigment which adheres when spread in a thin coat. Other marking liquids or marking materials could be used, though some features of the invention, such as hydraulic circuit 140 described for pumping a liquid, are usable only for liquid marking materials. Other features of the invention are usable with both wet and dry marking materials, e.g. the rear spray position of spray nozzle 16" does not depend upon the nature of the marking material, how side shields 48" adjust, etc.

Various modifications of the disclosed embodiments of this invention will be apparent to those skilled in the art. The surface being marked by line markers 2, 2' can comprise any more or less horizontal surface, whether paved or unpaved, such as a paved street or parking lot, or an unpaved turf surface such as a baseball, football or soccer field, etc. Thus, the scope of this invention is to be limited only by the appended claims.

We claim:

1. A hydraulic circuit for a line marker having a spray nozzle for spraying a marking liquid downwardly to mark a line on a horizontal surface, which comprises:

(a) a reservoir for holding a supply of the marking liquid, wherein the reservoir further includes a drain outlet for draining liquid from the tank;

(b) a pump for pumping the marking liquid from the reservoir and for supplying the marking liquid to the spray nozzle;

(c) a selectively operable control valve which permits spray of the marking liquid from the spray nozzle when the control valve is in a first state and which prevents spray of the marking liquid from the spray nozzle when the control valve is in a second state; and (d) a recirculation path for recirculating at least a portion of the marking liquid being pumped by the pump back to the reservoir when the control valve for the spray nozzle is in the second state, wherein the recirculation path includes:

(i) a reservoir inlet for receiving the recirculated portion of the marking liquid; and (ii) a reservoir hose operatively connected to the reservoir inlet with the reservoir hose being disposed inside the reservoir and extending around at least a portion of the reservoir for conducting the recirculated portion of the marking liquid into and at least partially through the reservoir, and wherein the reservoir hose is long enough to be selectively and manually redirected to pass into the drain outlet such that any liquid entering the reservoir through the reservoir hose is immediately dumped out of the reservoir through the drain outlet.

2. The hydraulic circuit of claim 1, wherein the recirculation path is configured to recirculate substantially all of the marking liquid being pumped by the pump back to the reservoir when the control valve for the spray nozzle is in the second state.

3. The hydraulic circuit of claim 1, wherein the pump has a higher pumping capacity than an output capacity of the spray nozzle such that at least a portion of the marking liquid being pumped by the pump continues to recirculate back to the reservoir through the recirculation path when the control valve for the spray nozzle is in the first state.

4. A hydraulic circuit for a line marker having a spray nozzle for spraying a marking liquid downwardly to mark a line on a horizontal surface, which comprises:

(a) a reservoir for holding a supply of the marking liquid and a tank for holding a supply of water for flushing the hydraulic circuit;

(b) a pump for pumping the marking liquid from the reservoir in a marking mode of operation and for pumping water from the tank in a flush mode of operation;

(c) a selectively operable control valve which permits spray of the marking liquid from the spray nozzle when the control valve is in a first state and which prevents spray of the marking liquid from the spray nozzle when the control valve is in a second state;

(d) a recirculation path for recirculating at least a portion of the marking liquid being pumped by the pump back to the reservoir when the control valve for the spray nozzle is in the second state; and (e) a selectively operable outlet valve having a pair of inlets operatively connected to the reservoir and the tank, respectively, the outlet valve being selectively shiftable to either draw marking liquid from the reservoir in the marking mode of operation or water from the tank in the flush mode of operation, and wherein the outlet valve has a liquid outlet connected to the pump.

5. The hydraulic circuit of claim 4, further including a selectively operable inlet valve operatively connected in the recirculation path to the reservoir, wherein the inlet valve is selectively shiftable to either permit the recirculated portion of the marking liquid to enter the reservoir in the marking mode of operation or to prevent any water from entering the reservoir in the flush mode of operation.

6. The hydraulic circuit of claim 5, wherein the inlet and outlet valves are interlinked by a common operator so that the outlet valve is disposed to draw marking liquid from the reservoir whenever the inlet valve permits the recirculated portion of the marking liquid to enter the reservoir in the marking mode and the outlet valve is disposed to draw water from the tank whenever the inlet valve prevents any liquid from entering the reservoir in the flush mode.

7. The hydraulic circuit of claim 5, wherein the inlet valve in the flush mode of operation receives at least a portion of the water being pumped by the pump and recirculates the water portion back into the flow of water in the hydraulic circuit.

8. The hydraulic circuit of claim 7, wherein the inlet valve recirculates the water portion back to the outlet valve.

9. The hydraulic circuit of claim 1, wherein the pump supplies the marking liquid to the spray nozzle and to the recirculation path from a pressure regulator.

10. A hydraulic circuit for a line marker having a spray nozzle for spraying a marking liquid downwardly to mark a line on a horizontal surface, which comprises:

(a) a reservoir for holding a supply of the marking liquid;

(b) a tank for holding a supply of water;

(c) an outlet valve for drawing marking liquid from the reservoir in a marking mode of operation or water from the tank in a flush mode of operation; and (d) a pump for pumping whatever liquid passes through the outlet valve to the spray nozzle.

11. The hydraulic circuit of claim 10, wherein the spray nozzle is carried on a frame of the line marker in the marking mode of operation but may be disconnected from the frame of the line marker in the flush mode of operation, and wherein the spray nozzle is supplied with liquid through a conduit that is long enough to allow the spray nozzle in the flush mode of operation to be repositioned over a fill inlet of the reservoir to direct back into the reservoir marking liquid purged from the hydraulic circuit during an initial stage of the flush mode of operation.

12. The hydraulic circuit of claim 10, further including an inlet valve for recirculating marking liquid into the reservoir in the marking mode of operation or for recirculating water back into the water flow from the tank in the flush mode of operation.

13. The hydraulic circuit of claim 12, wherein the inlet and outlet valves are selectively shifted from the marking mode of operation to the flush mode of operation by a common valve operator.

14. A method of operating a hydraulic circuit of a line marker, the hydraulic circuit comprising a reservoir on the line marker for holding a supply of marking liquid, a tank on the line marker for holding a supply of water, a pump on the line marker for pumping liquid, and a spray nozzle on the line marker for spraying the marking liquid downwardly to mark a line on a horizontal surface, which comprises:

(a) pumping the marking liquid from the reservoir through the pump and to the spray nozzle during a marking mode of operation; and (b) pumping water from the tank through the pump and to the spray nozzle during a flush mode of operation.

15. The method of claim 14, further including the step of rinsing the reservoir with water from an external water source and pumping such water from the reservoir through the pump during a clean out mode of operation.

16. The method of claim 15, further including the step of recirculating at least a portion of the marking liquid in a recirculation path from the pump back to the reservoir during the marking mode of operation.

17. The method of claim 16, further including the step of using the recirculation path of the marking mode of operation for recirculating the rinse water in the clean out mode of operation back to the reservoir during the clean out mode of operation and for dumping such rinse water from the reservoir through a drain outlet of the reservoir.

18. The method of claim 17, further including the step of directing the recirculated rinse water in the clean out mode of operation through a hose for direct passage from an inlet to the reservoir to the drain outlet of the reservoir.

19. The method of claim 14, further including the steps of:

(a) disconnecting the spray nozzle from the line marker but leaving the spray nozzle connected in the hydraulic circuit during the flush mode of operation; and (b) holding such disconnected spray nozzle over a fill inlet of the reservoir to return any marking liquid purged from the hydraulic circuit during an initial phase of the flush mode of operation to the reservoir.

* * * * *

UNITED STATES PATENT AND TRADEMARK OFFICE

CERTIFICATE OF CORRECTION

PATENT NO. : 7,140,555 B1
APPLICATION NO. : 11/132734
DATED : November 28, 2006
INVENTOR(S) : Benjamin A. Bricko et al.

It is certified that error appears in the above-identified patent and that said Letters Patent is hereby corrected as shown below:

Col. 19, Line 27, change “tank” to --reservoir--.

Signed and Sealed this

Thirteenth Day of February, 2007

JON W. DUDAS
*Director of the United States Patent and Trademark Office*